US007959718B2

(12) United States Patent
Takayanagi

(10) Patent No.: US 7,959,718 B2
(45) Date of Patent: Jun. 14, 2011

(54) FLOTAGE TRAPPING DEVICE AND FLOTAGE REPELLING DEVICE

(75) Inventor: Makoto Takayanagi, Hamamatsu (JP)

(73) Assignee: Trinc. Org, Shizuoka (JP)

( * ) Notice: Subject to any disclaimer, the term of this patent is extended or adjusted under 35 U.S.C. 154(b) by 464 days.

(21) Appl. No.: 11/776,473

(22) Filed: Jul. 11, 2007

(65) Prior Publication Data

US 2008/0014851 A1 Jan. 17, 2008

(30) Foreign Application Priority Data

Jul. 13, 2006 (JP) ..... 2006-192273
Nov. 13, 2006 (JP) ..... 2006-306140

(51) Int. Cl.
*B03C 3/41* (2006.01)
*B03C 3/45* (2006.01)
*B03C 3/60* (2006.01)

(52) U.S. Cl. ..... 96/95; 96/96; 96/99

(58) Field of Classification Search ..... 96/78, 79, 96/95–99

See application file for complete search history.

(56) References Cited

U.S. PATENT DOCUMENTS 2,861,261 A * 11/1958 Coolidge, Jr. et al. ..... 96/26
2,970,670 A * 2/1961 Nodolf ..... 96/79
3,678,653 A * 7/1972 Buschman ..... 96/66
4,018,577 A * 4/1977 Shibuya et al. ..... 96/78
4,166,729 A * 9/1979 Thompson et al. ..... 96/79
4,472,174 A * 9/1984 Chuan ..... 95/58
4,569,684 A * 2/1986 Ibbott ..... 96/79
4,673,416 A * 6/1987 Sakakibara et al. ..... 96/79
5,037,456 A * 8/1991 Yu ..... 96/76
5,198,003 A * 3/1993 Haynes ..... 96/78
5,993,738 A * 11/1999 Goswani ..... 422/22
6,003,434 A * 12/1999 Forster ..... 95/57
6,080,225 A * 6/2000 Forster ..... 95/57
6,090,189 A * 7/2000 Wikstrom et al. ..... 96/69
6,163,098 A * 12/2000 Taylor et al. ..... 310/308
6,203,600 B1 * 3/2001 Loreth ..... 96/40
7,833,323 B2 * 11/2010 Takayanagi et al. ..... 96/24
2005/0051028 A1 * 3/2005 Botvinnik ..... 96/88
2005/0150384 A1 * 7/2005 Krichtafovitch et al. ..... 96/58
2008/0250929 A1 * 10/2008 Takayanagi et al. ..... 96/24

FOREIGN PATENT DOCUMENTS

JP 53-84274 A * 7/1978 ..... 96/78

* cited by examiner

*Primary Examiner* — Richard L Chiesa
(74) *Attorney, Agent, or Firm* — Leighton K. Chong

(57) ABSTRACT

A flotage trapping device has at least one plus electrode and at least one minus electrode. The plus electrode and minus electrode are alternately disposed. The electrodes trap the flotage floating in the air. Another flotage trapping device has at least one electrode of a single polarity and a space ion generating device for generatingions of polarity opposite to that of the electrode so as to form an ion space around or adjacent the electrode. A flotage repelling device has at least one electrode of a single polarity, and a space ion generating device for generating ions of the same polarity as that of the electrode so as to form an ion space around or adjacent of the electrode.

1 Claim, 27 Drawing Sheets

FLOTAGE TRAPPING DEVICE AND FLOTAGE REPELLING DEVICE

TECHNICAL FIELD

This invention generally relates to a dust control device or a dustproof device, and more particularly, to a flotage trapping device for trapping or capturing a flotage such as floating dust and a dust repelling device for keeping dust away from the object of dust removal or a dustproof region in order to control dust.

BACKGROUND OF INVENTION

Except for conventional flotage trapping devices which control flotage so that the flotage is kept away from the predetermined region, conventional flotage trapping devices for trapping flotage such as dust include the following techniques:

(1) a system in which an air is blown toward the flotage by a fan and the flotage is removed by a filter or a fiber, (2) a system in which an air is blown toward the flotage by a fan and the flotage is collected by application of electric field, (3) a system in which an air is blown toward the flotage by a fan and the flotage is removed by a filter or a fiber which is provided with electric field, (4) a system in which an air is blown toward the flotage by a fan, the flotage is caused to be charged by ions and is captured by electrodes, and (5) a system in which the flotage is captured by a mesh provided with an adhesive and the like.

Except for the system using an adhesive, in either one of the above-mentioned systems an air blower such as a fan is provided within a housing, air is blown toward the flotage and then the flotage is collected. Therefore, mainly the flotage is removed by a filter or fiber, or the flotage is caused to be charged by ions and then captured by electrodes provided with voltage.

In the conventional system (1) in which an air is blown toward the flotage by a fan and the flotage is removed by a filter or a fiber, since the fan generates an air flow or wind and thus the flotage flies high in the air, the system is adversely harmful as a measure for removing the dust. In the system air is inevitably taken in within a housing of a dust collecting device or flotage trapping device and then an airborne dust is trapped. For this reason a big dust collecting device cannot be installed. Since the resistance of filter or fiber is big, the speed of wind cannot be increased and thus processing power is limited. For example, a long time operation is required to trap the dust as a whole in a large space. Furthermore, the fan which blows wind toward a dense filter needs a considerable degree of wind pressure. Therefore there are problems in that consumed power increases and running cost is expensive.

FIG. 31 shows a conventional system (2) in which a fan blow a wind toward the dust and the dust is collected by electric field. Since the fan generates an air flow or wind and thus the flotage flies high in the air, the system is adversely harmful as a measure for removing the dust. In the system air is inevitably taken in within a housing of a dust collecting device or flotage trapping device and then an airborne dust is trapped. For this reason a big dust collecting device cannot be installed. Since the air is blown slowly so that the electric field system works effectively, the speed of wind cannot be increased and thus processing power is limited. For example, a long time operation is required to trap the dust as a whole in a large space.

The dust collecting device for use in the system shown in FIG. 31 will be explained in more detail. The dust collecting device 1 or flotage trapping device includes a housing 8. Plate-like electrodes 10 are provided at the walls of the housing. That is, a plus or positive electrode 10*a* which is fed by a power supply 20 so as to be positively charged and minus or negative electrodes 10*b* which are fed by a power supply 20 so as to be negatively charged are disposed in juxtaposition. The electric flux lines 14 come out from the plus electrode 10*a* and are terminated at the minus electrodes 10*b* in a direction as shown by arrows. Within the housing 8, a fan 22 is disposed at the downstream of the electrodes 10*a* and 10*b*, and as shown by arrows 18 an air blow is flown from the upstream to the downstream. Assumed that the dust (plus dust 12*a* charged with plus electricity, minus dust 12*b* charged with minus electricity, and dust 12*c* without charge) exists at the upstream of the dust collecting device.

Now, when the fan is operated, the upstream dust is attracted toward the housing as shown in arrows 16 and is moved downstream between the plus electrode 10*a* and the minus electrodes 10*b*. At that time the plus dust 12*a* and minus dust 12*b* are respectively trapped or captured by the electrodes of opposite polarities. However, the dust 12*c* without charge is not trapped and thus moved downstream.

FIG. 32 shows the conventional system (3) in which a wind is blown by a fan toward the dust and the dust is removed by a filter or fiber provided with electric field. Since in the system the fan blows a wind, the dust flies high and thus the system is adversely harmful as a measure for dust. In the system air is inevitably taken in within a housing of a dust collecting device or flotage trapping device and then an airborne dust is trapped. For this reason a big dust collecting device cannot be installed. Since the resistance of filter or fiber is big, the speed of wind cannot be increased and thus processing power is limited. For example, a long time operation is required to trap the dust as a whole in a large space.

Furthermore, since the filter is provided with electrodes, this filter other than a simple filter without electrode is expensive, and the running cost for exchange of filter is added. Furthermore the fan which blows a wind toward a dense filter needs a considerable degree of wind pressure. Therefore there are problems in that consumed power increases and running cost is expensive.

The dust collecting device using the system as shown in FIG. 32 will be explained in more detail. The dust collecting device comprises a housing 8. Within the housing, a mesh-like high voltage electrode 10, plus electrode 10*a* in the embodiment, is provided inside a filter or fiber 24 and a grounded electrode 10*c* is provided on the surfaces of the fiber 24 opposed to the electrode 10*a*. Furthermore, within the housing, a fan 22 is disposed at the downstream of the fiber 24 with electrode and air blow is adapted to flow from the upstream to the downstream as shown by arrows 18.

Now, when the fan 22 is operated the upstream dust is sucked in within the housing as shown by arrows 16 and is passed through the fiber 24 with electrode. The charged dust is captured by polarized fiber and electrode, and non-charged dust is captured by the fiber.

FIG. 33 shows a conventional system (4) in which a wind is blown by a fan, the flotage such as dust is caused to be charged by ions and captured by electrodes. Since the fan generates an air flow or wind and thus the flotage flies high in the air, the system is adversely harmful as a measure for removing the dust. In the system air is inevitably taken in within a housing of a dust collecting device or flotage trapping device and then an airborne dust is trapped. For this reason a big dust collecting device cannot be installed. Since the air is blown slowly so that the electric field system works effectively, the speed of wind cannot be increased and thus processing power is limited. For example, a long time operation is required to trap the dust as a whole in a large space.

The dust collecting device using the system as shown in FIG. 33 will be explained in more detail. The dust collecting device 1 comprises a housing 8. The electrodes, plus hollow cylindrical electrodes 10*a* in the embodiment, which are grounded or are fed by a power supply 20 are disposed on the wall of the housing 8 opposite to each other. Within the housing 8, a discharge needle 26 fed by the power supply 20 is provided at the upstream of the electrodes 10 so as to issue minus ions 28*b* toward the upstream, and a fan is disposed at the downstream of the electrodes 10, and thus air blow is adapted to flow from the upstream to the downstream as shown by arrows 18.

Now, when the fan 22 is operated, the upstream dust 12 is sucked in within the housing 8 as shown by arrows 16, and within the housing the dust is caused to be charged with minus electricity by the minus ions 28*b*. The dust is attracted by the plus electrodes 10*a* and captured by the electrodes 10*c* or 10*a*.

In the conventional system (5) in which the dust is captured by attachment to a mesh coated with adhesive, due to the function of capturing the attached dust, the capture depends on accidental attachment to fine threads of the mesh. Its capture efficiency is very low compared with forcible capture as made by other systems.

Therefore, it is an object of the present invention to provide a flotage trapping or capturing device which can capture the flotage such as dust in a simple construction and is not expensive.

It is another object of the present invention to provide a flotage repelling device which can repel the flotage such as dust in a simple construction and is not expensive.

SUMMARY OF INVENTION

To accomplish the object, there is provided a flotage trapping device which comprises at least one plus electrode and at least one minus electrode, said plus electrode and minus electrode being alternately disposed, wherein said electrodes trap the flotage floating in the air.

It is preferable that the plus electrode and the minus electrode are covered with either one of an insulator, adhesive, a combination of a first layer of insulator and a second layer of adhesive, a combination of a first layer of insulator, a second layer of adhesive and a third layer of sterilizer, a combination of a first layer of insulator and a second layer of adhesive including a sterilizer, a highly resistive element, a conductive adhesive, and a photocatalyst.

There is provided a flotage trapping device which comprises at least one electrode of a single polarity and a space ion generating device for generating ions of polarity opposite to that of said electrode so as to form an ion space around or adjacent said electrode.

There is provided a flotage trapping device which comprises a plurality of electrodes of a single polarity disposed to surround a space so as to form a dust control space and a space ion generating device for generating ions of polarity opposite to that of electrode so as to form an ion space which surrounds said dust control space.

There is provided a flotage trapping device in which the polarity of said electrode is switched over to collect the dust attached to said electrode.

There is provided a flotage trapping device which comprises at least one plus electrode disposed in the air and at least one minus electrode disposed in the air, said plus electrode and said minus electrode being alternately disposed, a space ion generating device for generating ions so as to form an ion space surrounding a plurality of said electrodes, switching means for switching over the polarity of said ions generated by said space ion generating device.

There is provided a flotage repelling device which comprises at least one electrode of a single polarity, and a space ion generating device for generating ions of the same polarity as that of said electrode so as to form an ion space around or adjacent of said electrode.

There is provided a flotage repelling device which comprises a plurality of electrodes of a single polarity disposed to form a dust control space so as to surround a space, and a space ion generating device for generating ions of the same polarity as that of said electrodes so as to surround said dust control space.

There is provided a flotage repelling device which comprises a space ion generating device for generating ions of a single polarity so as to form an ion space as a flotage repelling space around the object of dust control.

There is provided a flotage repelling device which comprises grounded electrodes disposed to surround a space so as to form a dust control space, and a space ion generating device for generating ions of a single polarity so as to form an ion space surrounding said dust control space.

Other objects, features, and advantages of the present invention will be explained in the following detailed description of the invention having reference to the appended drawings:

BRIEF DESCRIPTION OF DRAWINGS

FIG. 1 is a view for showing a first embodiment of the basic flotage trapping device according to the present invention, FIG. 2 is a view for showing a second embodiment of the flotage trapping device according to the present invention, FIG. 3 is a view for showing a third embodiment of the flotage trapping device according to the present invention, FIG. 5 is a view for showing a 4th embodiment of the flotage trapping device according to the present invention, FIG. 6 is a view for showing a 5th embodiment of the flotage trapping device according to the present invention, FIG. 7 is a view for showing a 6th embodiment of the flotage trapping device according to the present invention, FIG. 8 is a view for explanation on usages of the 5th and 6th embodiments, FIG. 9 is a view for explanation on usages of the prototype of the first embodiment and the coating mist trapping device or flotage trapping device using dust trapping net of the second embodiment, FIG. 10 is a view for explanation on usages of the prototype of the first embodiment and the dust trapping device for die assembly or the flotage trapping device using dust trapping net of the second embodiment, FIG. 11 is a view for explanation on a clean box using the flotage trapping device comprising the plate of the 5th embodiment or the sheet or film of the 6th embodiment, FIG. 17 is a view for explanation on a 17th embodiment of flotage trapping system, FIG. 23 is a view for explanation on another maintenance-free optical lens device using a space ion generating device comprising a single polarity of electrodes (plus electrodes or minus electrodes) and an ion generating device for generating ions of the opposite polarity as that of electrodes, FIG. 25 is a view for explanation on a still anther maintenance-free optical lens device using a space ion generating device comprising a single polarity of electrodes (plus electrodes or minus electrodes) and an ion generating device for generating ions of the same polarity as that of electrodes, FIG. 26 is a view for explanation on a still anther maintenance-free optical lens device using a space ion generating, FIG. 27 is a view for explanation on a maintenance-free optical lens using a grounded electrode and a space ion generating device, FIG. 30 is a view for explanation on the removal and withdrawal of trapped dust at the dust trapping device, FIG. 37 is a timing chart for power supply controller.

DETAILED DESCRIPTION OF THE INVENTION

First Embodiment

Figure 1A:
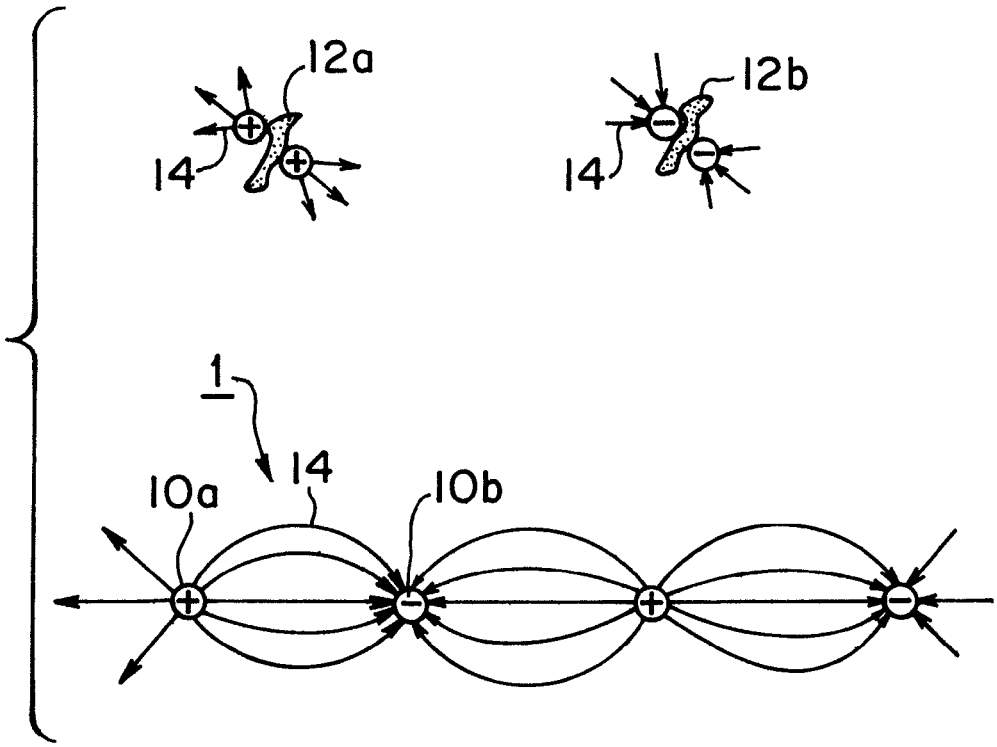
FIG. 1*a* shows a state before the flotage is trapped and FIG. 1*b* shows the process of trapping the flotage.
Figure 1B:
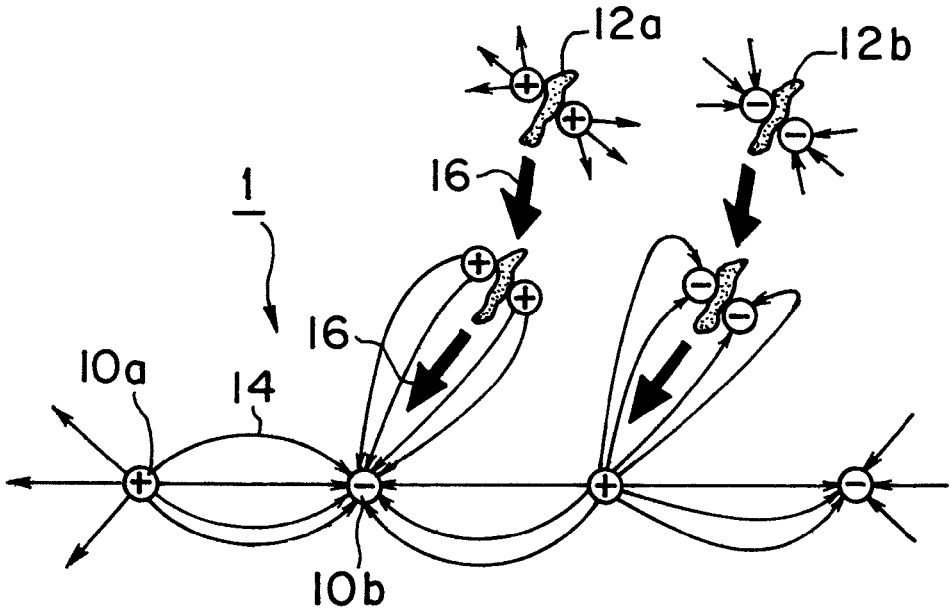

A first embodiment concerns a fundamental or prototype of construction of flotage trapping or capturing device. FIG. 1 is a view for showing a first embodiment of the basic flotage trapping device according to the present invention, FIG. 1*a* shows a state before the flotage is trapped and FIG. 1*b* shows the process of trapping the flotage. In FIG. 1 the flotage trapping device 1 comprises rod-like plus electrodes and minus electrodes. These plus and minus electrodes are alternately disposed at intervals of a predetermined distance.

As shown in FIG. 1*a* the dust charged with plus electricity 12*a*, hereinafter referred to as plus dust, has electric flux lines coming out from the dust and the dust charged with minus electricity 12*b*, hereinafter referred to as minus dust, has electric flux lines terminated at the dust. When the electric flux lines coming out from the plus charge connects the electric flux lines terminated at the minus charge, the attractive force is generated between both charges. When the electric flux lines coming out from the plus charge encounter with the plus charge, repulsive force is generated between both charges. Furthermore, when the electric flux lines coming out from the minus charge encounter with the minus charge, repulsive force is generated between both charges. In the state as shown in FIG. 1*a* the plus dust 12*a* and minus dust 12*b* sufficiently stay away from the plus and minus electrodes 10*a* and 10*b*, and thus are not affected by either of the plus and minus electrodes 10*a* and 10*b*.

Now, as shown by arrows 16 of FIG. 1*b*, when the plus dust 12*a* comes close to electrodes 10 sufficiently, the electric flux lines which come out from the plus charge of the plus dust 12*a* and the electric flux lines which are terminated at the minus electrode 10*b* are caused to be combined and thus the attractive force is generated between both charges. As a result the plus dust 12*a* is attracted to the minus electrode 10*b* and then captured thereby. In a similar manner, when the minus dust 12*b* comes close to the electrodes 10 sufficiently, the electric flux lines which are terminated at the minus charge of the minus dust 12*b* and the electric flux lines which come out from the plus electrode 10*a* are caused to be combined and thus the attractive force is generated between both charges. As a result the minus dust 12*b* is attracted to the plus electrode 10*a* and then captured thereby.

Thus, since the floating dust 12 is captured by the electrodes 10, and only a wind or air can pass through the flotage trapping device, even if there is non-clean area at the upstream of the flotage trapping device, the clean area can be maintained at the downstream of the flotage trapping device. Furthermore, since the flotage is forcibly captured by electric field even in a non-wind and calm atmosphere, a clean environment can be achieved in a wide area. Since no fan is used, the flotage is not scattered in the wind and the generation of defective goods due to the flotage can be suppressed.

Second Embodiment

Figure 2A:
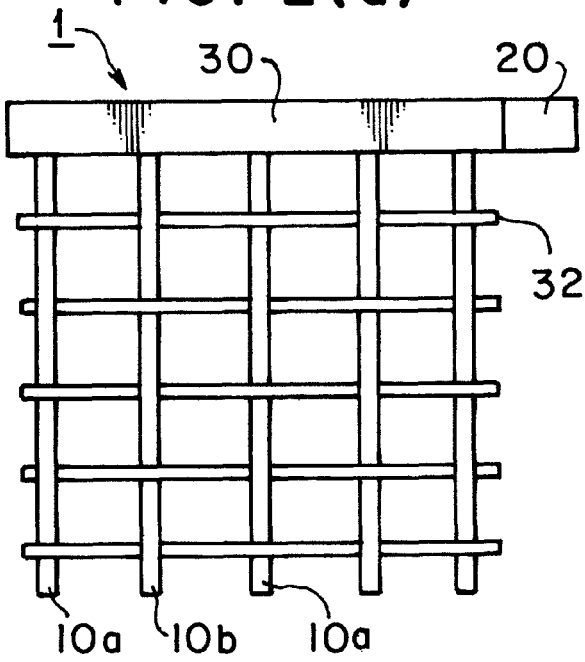
FIG. 2*a* is its front view.
Figure 2B:
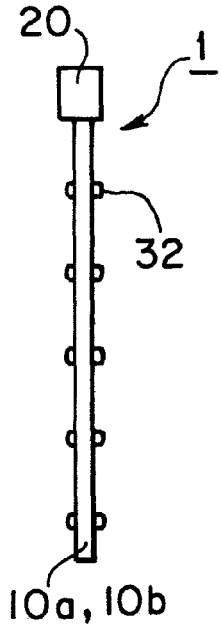
FIG. 2*b* is its side view.

The second embodiment concerns a specific example of prototype of flotage trapping device described in the first embodiment. FIG. 2 is a view for showing a second embodiment of the flotage trapping device according to the present invention, FIG. 2*a* is its front view, and FIG. 2*b* is its side view. In FIG. 2, the flotage trapping device 1 is constructed as a dust trapping net. The net 1 is knitted by its warps of plus electrode 10*a* and minus electrode 10*b* and its wefts of insulator 32. Furthermore, the electrodes may be covered with insulators. The electrodes are supplied with voltage through a feeder 30 from a power supply 20.

In accordance with the principle explained in the first embodiment, the flotage is attracted by the electrodes of polarity opposite to that of the flotage. The flotage is usually charged more or less. Although it happens that the flotage completely has no charge, it is a rare case. As the flotage without charge floats while it comes into collision with or gets in touch with the other flotage, the flotage is charged in a minute and thus no charge state becomes lost. As a result, the flotage is trapped by the electrodes sooner or later. Since the floating dust is captured by the electrodes, and only a wind or air can pass through the flotage trapping device, even if there is non-clean area at the upstream of the flotage trapping device, the clean area can be maintained at the downstream of the flotage trapping device. Furthermore, since the flotage is forcibly captured by electric field even in a non-wind and calm atmosphere, a clean environment can be achieved in a wide area. Since no fan is used, the flotage is not scattered in the wind and the generation of defective goods due to the flotage can be suppressed.

Third Embodiment

Figure 3A:
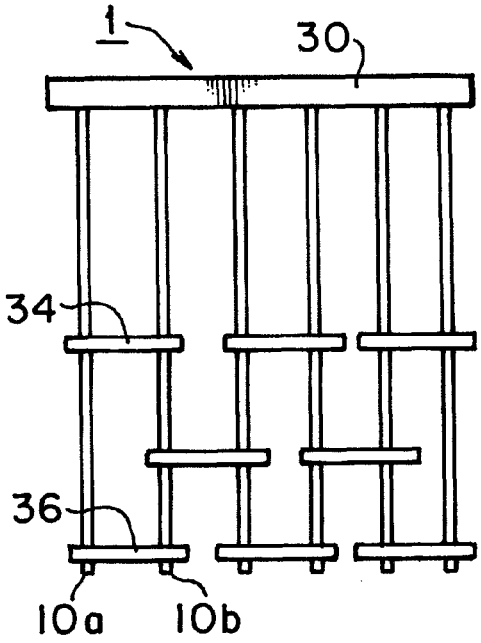
FIG. 3*a* is its front view.
Figure 3B:
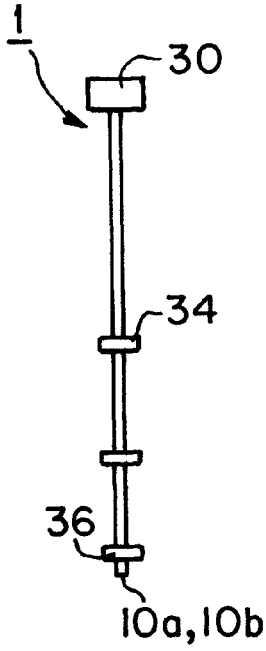
FIG. 3*b* is its side view.

The third embodiment concerns another specific example of prototype of flotage trapping device described in the first embodiment. FIG. 3 is a view for showing a third embodiment of the flotage trapping device according to the present invention, FIG. 3*a* is its front view, and FIG. 3*b* is its side view. In FIG. 3 the flotage trapping device 1 is constructed as a hanging warp for trapping. The hanging warp 1 comprises warps of plus electrodes 10*a* and minus electrodes 10*b* without weft. However, the hanging warp 1 is provided with insulator spacers 34 in some places to maintain intervals in a lateral direction between the electrodes. Furthermore, the electrodes are provided at their lower ends with weights. Since the plus electrode and the minus electrode are attracted to each other and cling together, the weights prevent the clinging and makes the warps to hang strait without being effected by disturbance such as wind. The electrodes may be covered with an insulator. The electrodes is supplied with a voltage by a feeder 30 which in turn is supplied with a voltage by a power supply, not shown. The flotage is attracted by electrodes of polarity opposite to that of the flotage.

Thus, since the floating dust is captured by the electrodes, and only a wind or air can pass through the flotage trapping device, even if there is non-clean area upstream of the flotage trapping device, the clean area can be maintained at the downstream of the flotage trapping device. Furthermore, since the flotage is forcibly captured by electric field even in a non-wind and calm atmosphere, a clean environment can be achieved in a wide area. Since no fan is used, the flotage is not scattered in the wind and the generation of defective goods due to the flotage can be suppressed.

4th Embodiment

Figure 4:
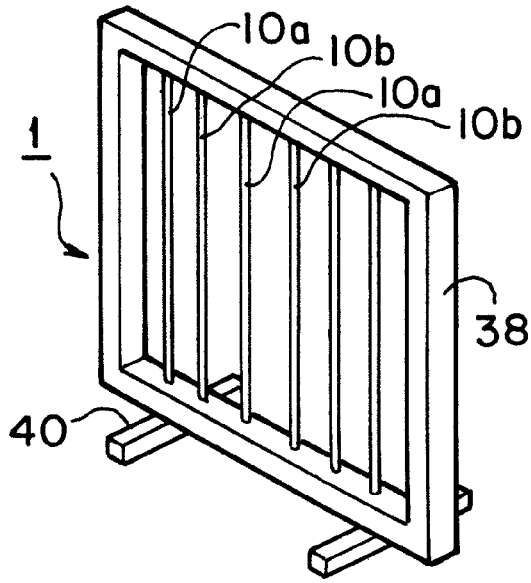
FIG. 4 is a perspective view for showing a 4th embodiment of the flotage trapping device according to the present invention.
Figure 5A:
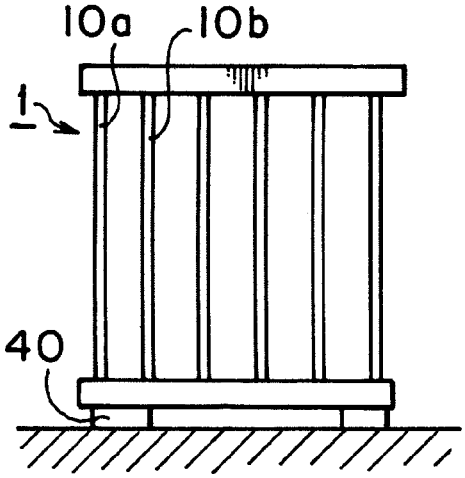
FIG. 5*a* is its front view.
Figure 5B:
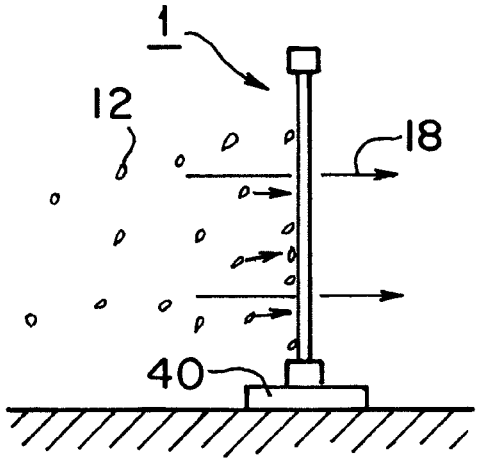
FIG. 5*b* is its side view.
Figure 5C:
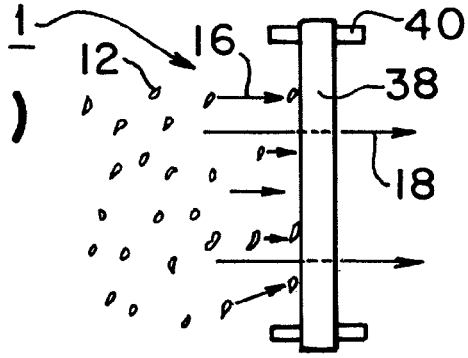
FIG. 5*c* is its plan view.

The 4th embodiment concerns a still another specific example of prototype of flotage trapping device described in the first embodiment. FIG. 4 is a perspective view for showing a 4th embodiment of the flotage trapping device according to the present invention. FIG. 5 is a view for showing a 4th embodiment of the flotage trapping device according to the present invention, FIG. 5*a* is its front view, FIG. 5*b* is its side view, and FIG. 5*c* is its plan view. In FIGS. 4 and 5, the flotage trapping device 1 is constructed as a dust trapping fence. The dust trapping fence 1 includes a lattice-like arrangement of electrodes within a frame 38 of an insulator and plus electrodes 10*a* and minus electrodes 10*b* are alternately disposed. Although the electrodes may be merely made of conductors, it is preferable that they are covered with insulators. Since the dust trapping fence 1 is sometimes set up, the dust trapping fence may be provided with legs 40. Thus, since the floating dust is captured by the dust trapping fence 1, and only a wind or air can pass therethrough, even if there is non-clean area at the upstream of the flotage trapping device, the clean area can be maintained at the downstream of the flotage trapping device. Furthermore, since the flotage is forcibly captured by electric field even in a non-wind and calm atmosphere, a clean environment can be achieved in a wide area. Since no fan is used, the flotage is not scattered in the wind and the generation of defective goods due to the flotage can be suppressed.

5th Embodiment

Figure 6A:
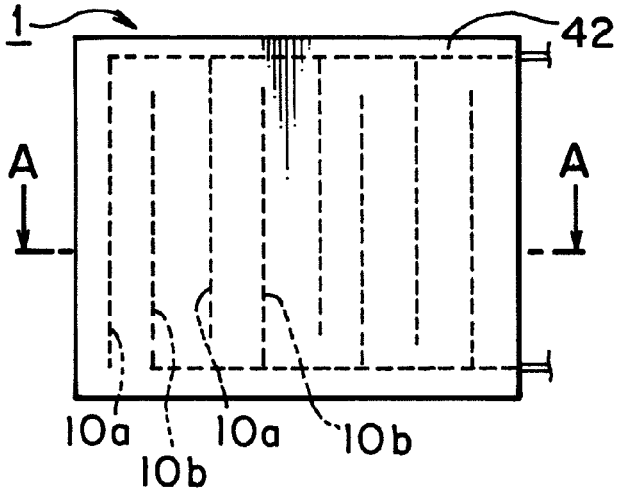
FIG. 6*a* is its front view.
Figure 6B:
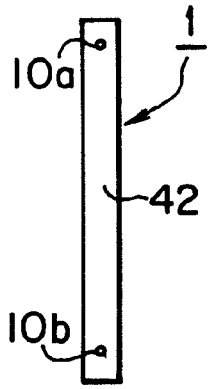
FIG. 6*b* is its side view.
Figure 6C:
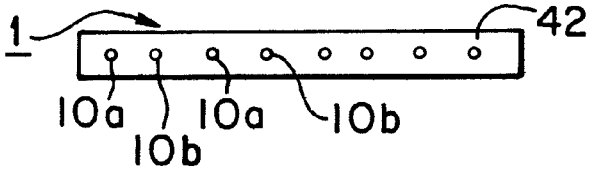
FIG. 6*c* is its cross-sectional view taken along line A-A of FIG. 6*a*.

The 5th embodiment concerns a still another specific example of prototype of flotage trapping device described in the first embodiment. FIG. 6 is a view for showing a 5th embodiment of the flotage trapping device according to the present invention, FIG. 6*a* is its front view, FIG. 6*b* is its side view, and FIG. 6*c* is its cross-sectional view taken along line A-A of FIG. 6*a*. In FIG. 6 the flotage trapping device 1 is constructed as a dust trapping plate. The dust trapping plate 1 includes a lattice-like arrangement of electrodes within a plate 42 made of an insulator and plus electrodes 10*a* and minus electrodes 10*b* are alternately disposed. Although the electrodes may be not covered, it is preferable that they are covered with insulators. Since the floating dust is captured by the electric field coming out from the plate 42 and thus is attached to the plate, a clean environment can be achieved in a wide area in proportion to the area of plate, and thus the generation of defective goods due to the flotage can be suppressed.

6th Embodiment

Figure 7A:
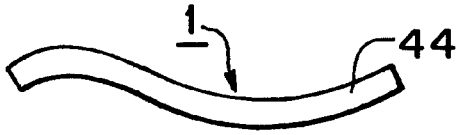
FIG. 7*a* is its plan view.
Figure 7B:
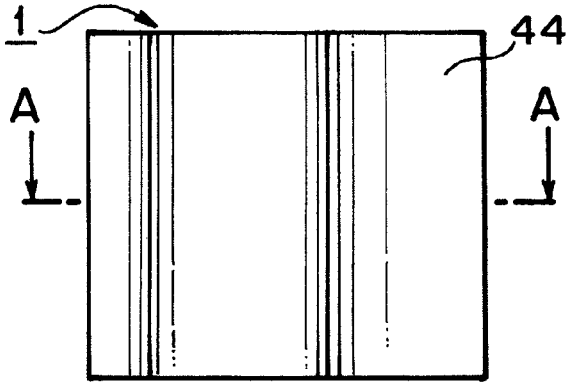
FIG. 7*b* is its front view.
Figure 7C:
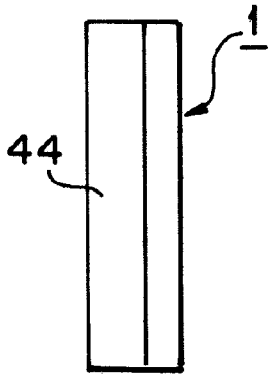
FIG. 7*c* is its side view.
Figure 7D:
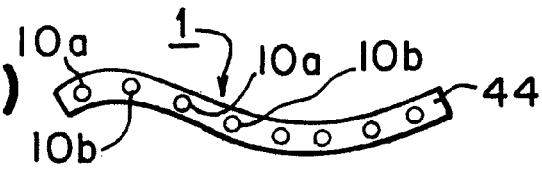
FIG. 7*d* is its cross-sectional view taken along line A-A of FIG. 7*b*.

The 6th embodiment concerns a still another specific example of prototype of flotage trapping device described in the first embodiment. FIG. 7 is a view for showing a 6th embodiment of the flotage trapping device according to the present invention, FIG. 7*a* is its plan view, FIG. 7*b* is its front view, FIG. 7*c* is its side view, and FIG. 7*d* is its cross-sectional view taken along line A-A of FIG. 7*b*. In FIG. 7, the flotage trapping device 1 is constructed as a dust trapping sheet or film. The dust trapping sheet 1 includes a lattice-like arrangement of electrodes within a flexible sheet 44 of an insulator, and plus electrodes 10*a* and minus electrodes 10*b* are alternately disposed. Although the electrodes may be not covered, it is preferable that they are covered with insulators. Since the floating dust is captured by the electric field coming out from the sheet or film 44 and thus is captured by the sheet, a clean environment can be achieved in a wide area in proportion to the area of sheet, and thus the generation of defective goods due to the flotage can be suppressed.

7th Embodiment

Figure 8A:
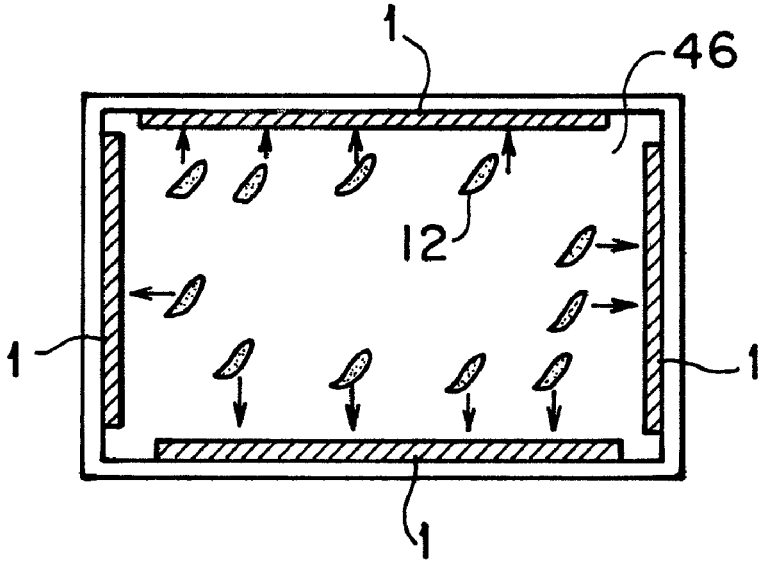
FIG. 8*a* is its plan view for the first usage.
Figure 8B:
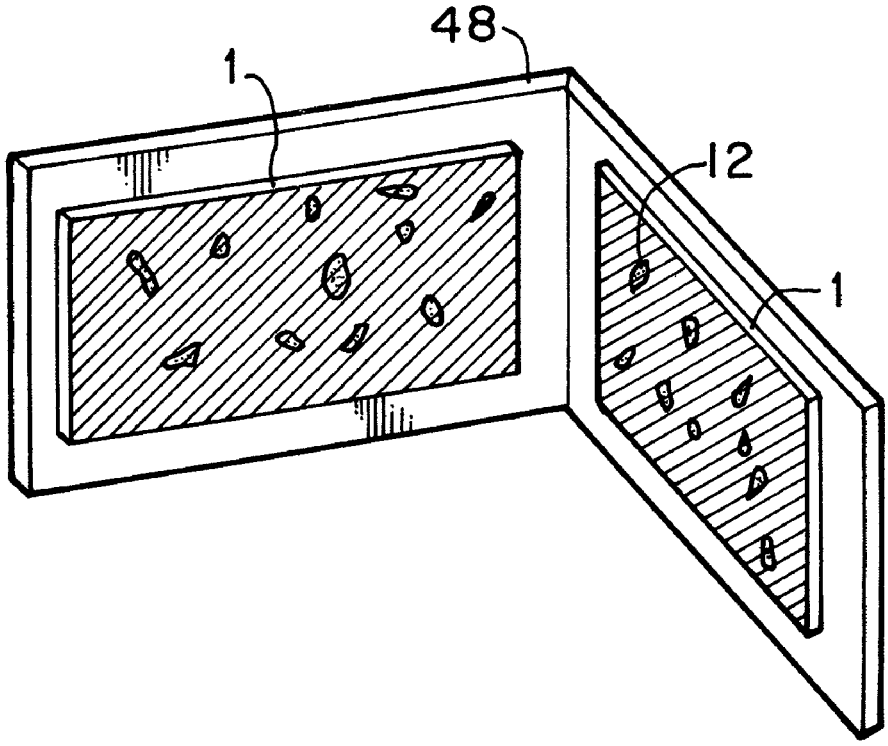
FIG. 8*b* is its perspective view for the second usage.

The 7th embodiment concerns the usages of the flotage trapping device preferably comprising the plate described in the 5th embodiment or the sheet described in the 6th embodiment. FIG. 8 is a view for explanation on usages of the 5th and 6th embodiments, FIG. 8*a* is its plan view for the first usage, and FIG. 8*b* is its perspective view for the second usage. In FIG. 8*a*, a plurality of flotage trapping devices 1, 4 flotage trapping devices in the embodiment, are attached to the walls surrounding a work room 46. Consequently the dust floating in the work room is captured by the flotage trapping devices and a clean environment can be maintained. In FIG. 8*b*, two flotage trapping devices are attached to a partition wall 48. The partition wall 48 is disposed at any proper place in the work area. The dust floating in the work area is captured by the flotage trapping devices and a clean environment can be maintained.

8th Embodiment

The 8th embodiment concerns the usage of coating mist trapping device preferably using the prototype described in the first embodiment and the dust trapping net described in the second embodiment. FIG. 9 is a view for explanation on usages of the prototype of the first embodiment and the coating mist trapping device or flotage trapping device using dust trapping net of the second embodiment, FIG. 9*a* is a view for explanation on the coating mist trapping device according to the present invention, and FIG. 9*b* is a view for explanation on conventional problems in case that the coating mist trapping device according to the present invention is not provided.

Figure 9A:
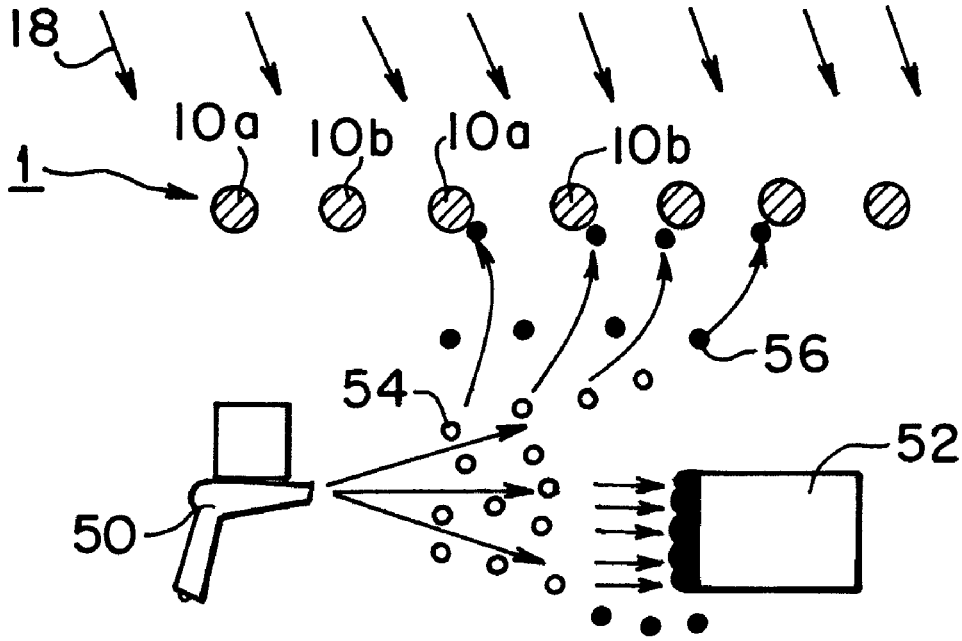
FIG. 9*a* is a view for explanation on the coating mist trapping device according to the present invention.
Figure 9B:
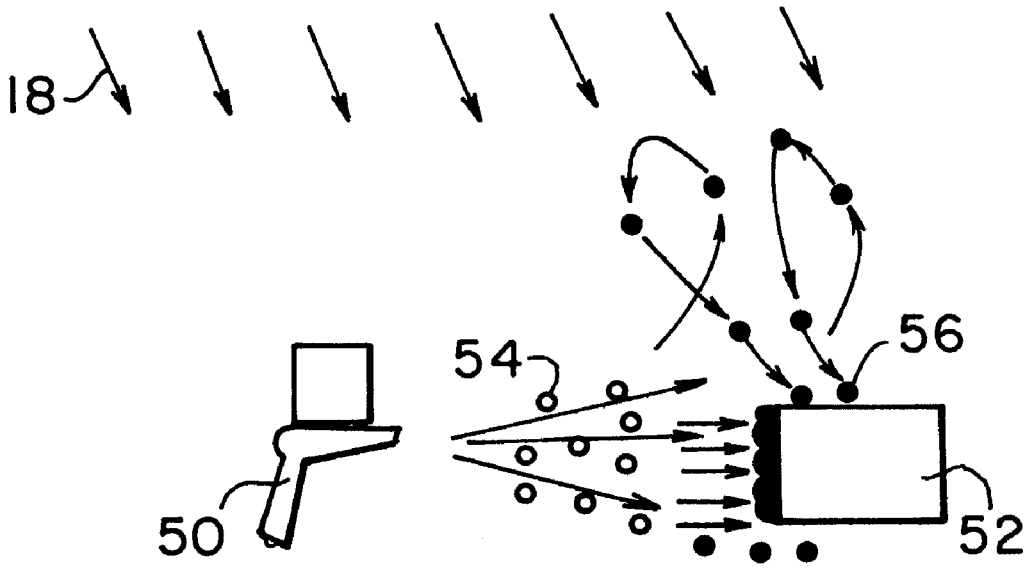
FIG. 9*b* is a view for explanation on conventional problems in case that the coating mist trapping device according to the present invention is not provided.

In FIG. 9*b*, when the coating 54, indicated by white circles, is sprayed on a work 52 by a coating spray gun 50, atomized coating particles or coating mist 56, indicated by black circles, flying in all directions appear in addition to the coating particles painted on the work 52. In the painting factories, a clean air which passes through a filter usually streams in the down-flow direction, indicated by 18. Therefore, the coating mist 56 flying in the down-flow direction streams downwardly and are collected, while the coating mist 56 flying in the up-direction streams downwardly again due to the down-flow 18. The downwardly streaming coating mist starts to get rigid as time goes on, and thus are attached to the work in the half-rigid state. The half-rigid coating mist is attached on the coated surface of the work as foreign materials and the work becomes a defective good due to irregularity of its surface.

On the other hand, as shown in FIG. 9*a*, in the present invention coating mist trapping device 1 comprising plus electrodes 10*a* and minus electrodes 10*b* captures the coating mist 56 flying upwardly. In case that a coating spray gun 50 sprays coating 54, when the coating particles 54 are injected through the nozzle of the spray gun 50, the coating particles come to be charged with electricity. The coating particles thus charged are attracted by electric field generated from the coating mist trapping device 1 and are captured by the electrodes. Therefore, the coating mist 56 moving downwardly again is reduced. Although the conventional problem is given up as an inevitable one at a factory site, the present invention solves this problem for the first time.

9th Embodiment

Figure 10A:
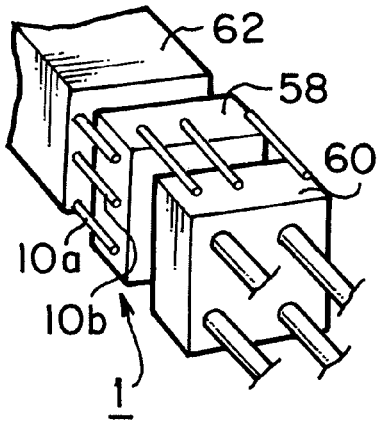
FIG. 10*a* is its perspective view for showing the dust trapping device for die assembly according to the present invention.
Figure 10B:
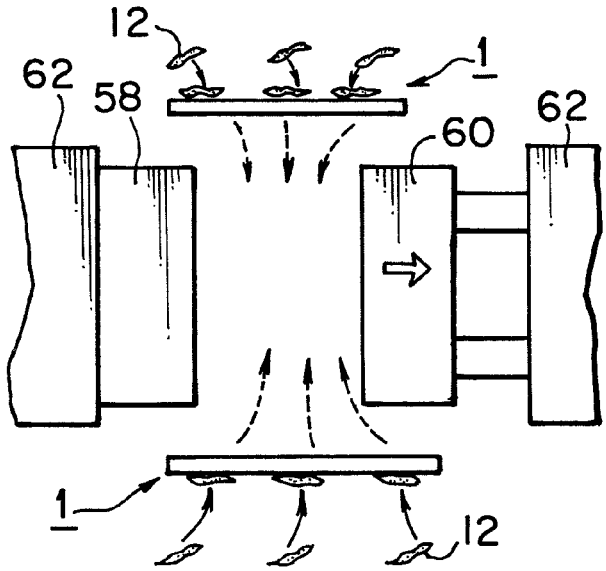
FIG. 10*b* is its cross-sectional view for showing the dust trapping device for die assembly according to the present invention.

The 9th embodiment concerns the usage of dust control device for die assembly or flotage trapping device preferably using the prototype described in the first embodiment and the dust trapping net described in the second embodiment. FIG. 10 is a view for explanation on usages of the prototype of the first embodiment and the dust trapping device for die assembly or the flotage trapping device using dust trapping net of the second embodiment, FIG. 10*a* is its perspective view for showing the dust trapping device for die assembly according to the present invention, FIG. 10*b* is its cross-sectional view for showing the dust trapping device for die assembly according to the present invention, and FIGS. 10*c* and 10*d* are cross-sectional views for explanation on conventional problems in case that the dust trapping device for die assembly according to the present invention is not provided.

Figure 10C:
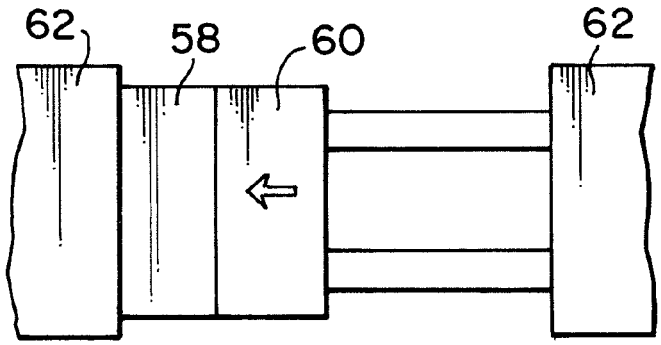
FIGS. 10*c* and 10*d* are cross-sectional views for explanation on conventional problems in case that the dust trapping device for die assembly according to the present invention is not provided.
Figure 10D:
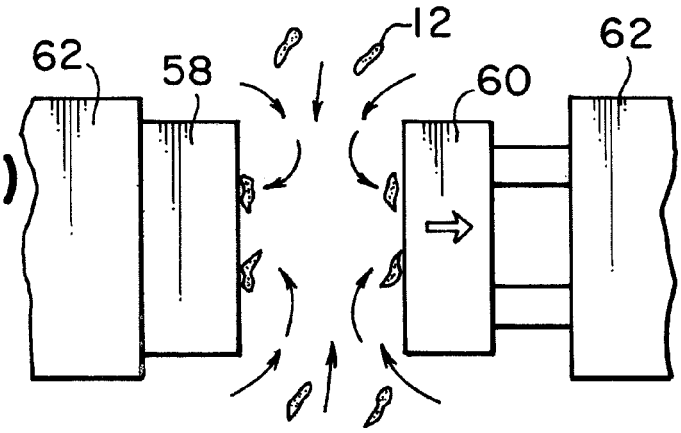

As shown in FIG. 10*c*, the molding is made by closing dies 58 and 60. As shown in FIG. 10*d*, when the dies 58 and 60 are opened after molding, the floating dust 12 flows into the die assembly from its environment on a wind. The dust attached to dies 58 and 60 is molded into the good in a next molding cycle, which result in the defective good. Furthermore, the reference numeral 62 indicates a machine.

On the other hand, as shown in FIGS. 10*a* and 10*b*, in the present invention, the dust control device for die assembly or the flotage trapping device comprising plus electrodes 10*a* and minus electrodes 10*b* is disposed around the dies 58 and 60. Therefore, when the dies 58 and 60 are opened, the dust control device for die assembly according to the present invention captures the floating dust 12 flowing into the die assembly from its environment on a wind. Consequently the generation of the defective goods can be suppressed.

10th Embodiment

Figure 11A:
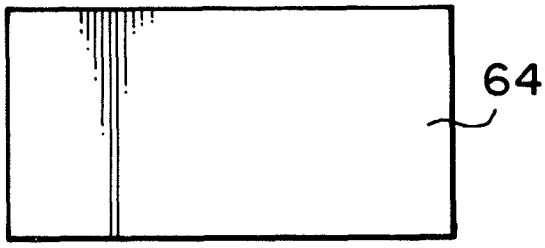
FIG. 11*a* is its plan view.
Figure 11B:
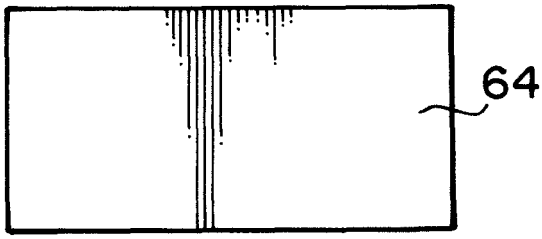
FIG. 11*b* is its front view.
Figure 11C:
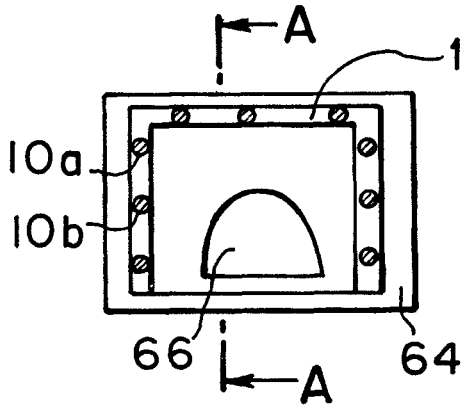
FIG. 11*c* is its side view and FIG. 11*d* is its cross-sectional view taken along line A-A of FIG. 11*c*.
Figure 11D:
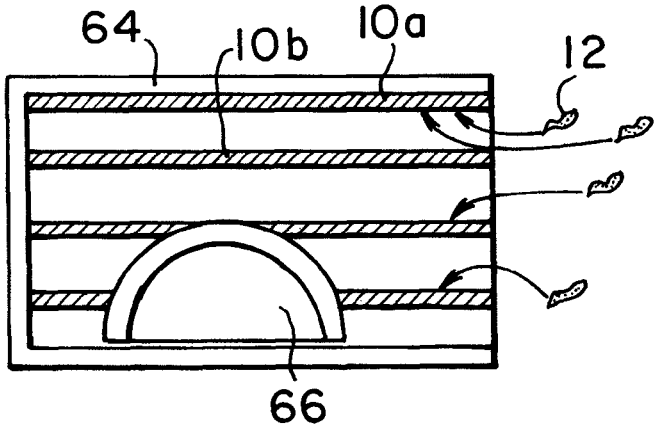

10th embodiment concerns the usage of the flotage trapping device preferably comprising the plate described in the 5th embodiment or the sheet or film described in the 6th embodiment. FIG. 11 is a view for explanation on a clean box using the flotage trapping device comprising the plate of the 5th embodiment or the sheet or film of the 6th embodiment, FIG. 11*a* is its plan view, FIG. 11*b* is its front view, FIG. 11*c* is its side view and FIG. 11*d* is its cross-sectional view taken along line A-A of FIG. 11*c*.

The flotage trapping device 1 comprising plus electrodes 10*a* and minus electrodes 10*b* is disposed within a clean box 64 at its inner walls. When the flotage 12 floating in the outside intends to enter the clean box 64, the flotage is attracted and captured by electric flux lines coming from electrodes 10*a* and 10*b* and thus is not attached to a deposit 66 in the clean box 64. Therefore, the clean box within which no dust floats can be achieved.

11th Embodiment

Figure 12:
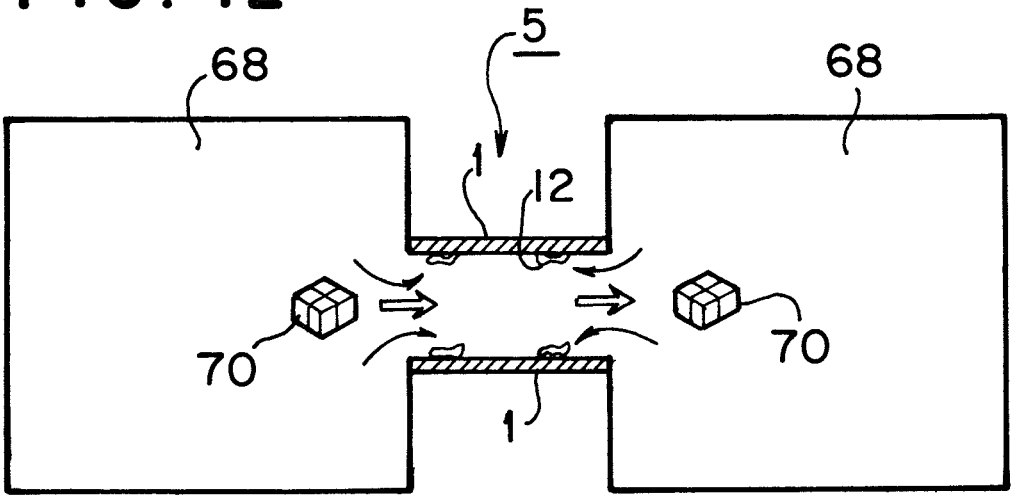
FIG. 12 is a diagrammatic view for showing a 11th embodiment of flotage trapping system.

The 11th embodiment concerns a flotage trapping system or the usage of the flotage trapping device preferably comprising the plate described in the 5th embodiment or the sheet or film described in the 6th embodiment. FIG. 12 is a diagrammatic view for showing a 11th embodiment of flotage trapping system. In FIG. 12, in a flotage trapping system 5, the flotage trapping device 1 is provided between clean environments such as clean benches 68, 68 at the delivery section through which members 70 are delivered.

When the door, not shown, through which a member 70 is delivered between the clean benches 68, 68 is opened, the wind is flown and the dust 12 moves between clean benches. On the side of the clean bench which the dust is flown in, the degree of cleanness is lowered and thus defective goods are generated. Therefore, when the flotage trapping device 1 is disposed at the delivery section within the inner walls thereof, the dust which is included in the wind bi-directionally flowing between the clean benches is captured by electrodes, not shown, provided on the flotage trapping device 1 at the inner walls of the delivery section, the wind is cleaned. As a result, contamination can be avoided for the clean bench which clean wind is flown in and the generation of the defective goods can be prevented. The conventional system using doors could not prevent flow-in of the dust at the time of delivery of members between clean environments.

12th Embodiment

Figure 13:
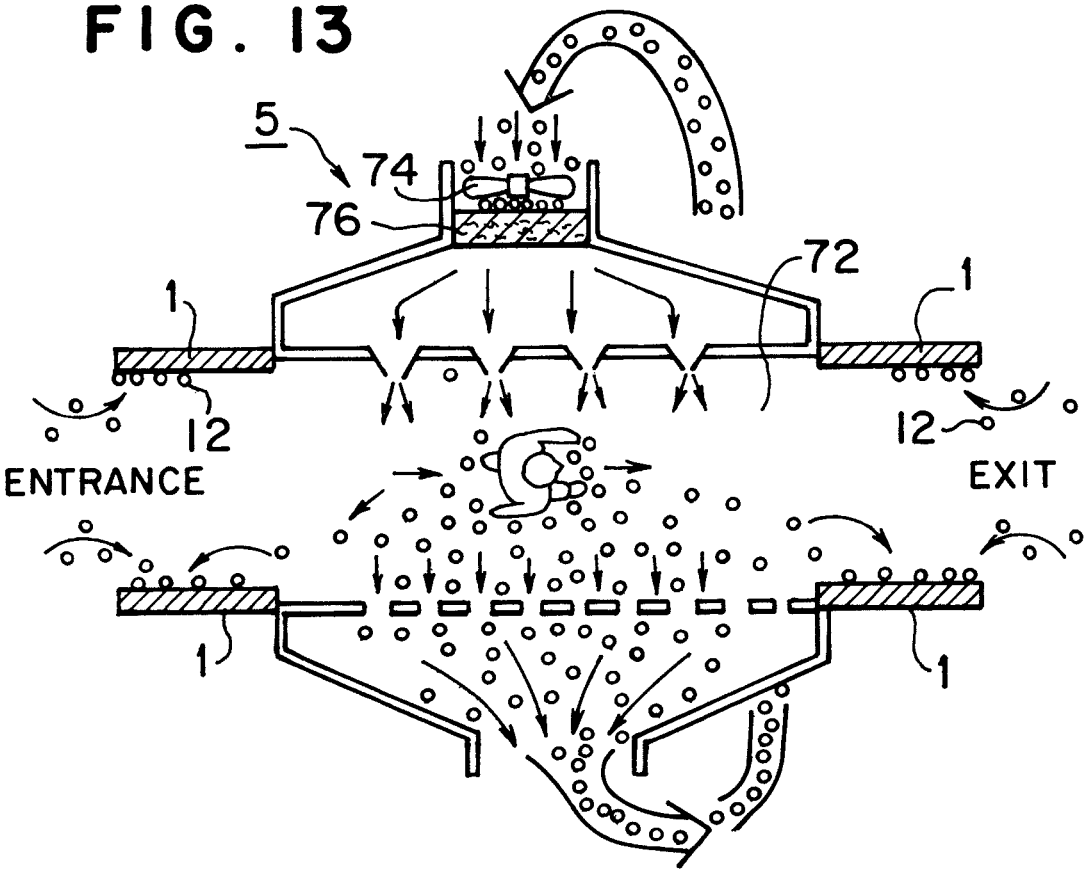
FIG. 13 is a diagrammatic view for showing a 12th embodiment of flotage trapping system.

The 12th embodiment concerns a flotage trapping system (air shower) or the usage of the flotage trapping device preferably comprising the plate described in the 5th embodiment or the sheet or film described in the 6th embodiment. FIG. 13 is a diagrammatic view for showing a 12th embodiment of flotage trapping system. In FIG. 13 the flotage trapping devices 1 are provided on the opposite walls at the entrance and exit of an air shower 72. On the center portion of the air shower there is a section which an air is drawn in through a fan 74 with a filter 76 to blow off the dust from the human body. No door, which is opened and closed, is provided at the entrance and exit and the human body freely can come in and out. Nevertheless, in case that the dust thus blown off comes out from the air shower 72 or comes in from the outside, since the dust can be captured by the flotage trapping devices disposed at the entrance and exit the dust cannot pass through the air-shower. In this manner, the air shower without door can be achieved.

Conventionally, since thousands of factory workers actually pass through the air shower in the morning and in the evening, that is, two times, the number of opening and closing of the doors reaches about hundred thousand times a year and thus the durability of doors becomes a problem. The cases that the doors do not work and many workers cannot enter the air shower occur frequently, which result in the problem of operation. On the other hand, since in the present invention the entrance and exit without door can be realized an epoch-making air shower can be achieved.

13th Embodiment

Figure 14:
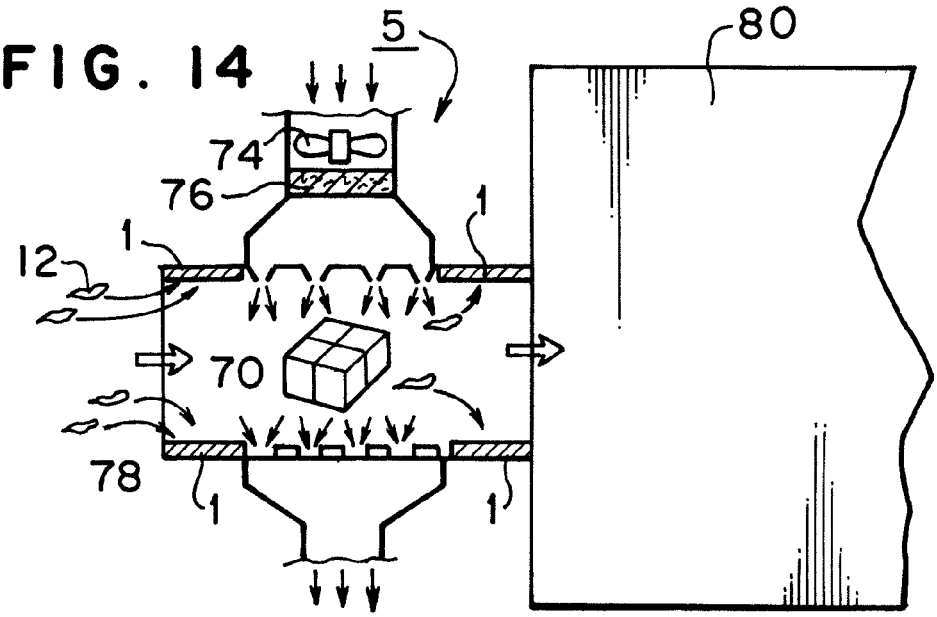
FIG. 14 is a diagrammatic view for showing a 13th embodiment of flotage trapping system.

The 13th embodiment concerns a flotage trapping system (pass box) or the usage of the flotage trapping device preferably comprising the plate described in the 5th embodiment or the sheet or film described in the 6th embodiment. FIG. 14 is a diagrammatic view for showing a 13th embodiment of flotage trapping system. In FIG. 14, a pass box 78 for delivering the member in a clean environment is provided with an air blower comprising a fan 74 with a filter 76 to blow off the dust from the member 70 delivered in, and is provided with the flotage trapping devices 1 on the both sides of entrance and exit in the front and rear of a central dust collection section of the pass box to capture the dust coming in a clean room 80. Even if there is no door, the dust cannot enter the clean room at the time of delivery of members.

14th Embodiment

Figure 15:
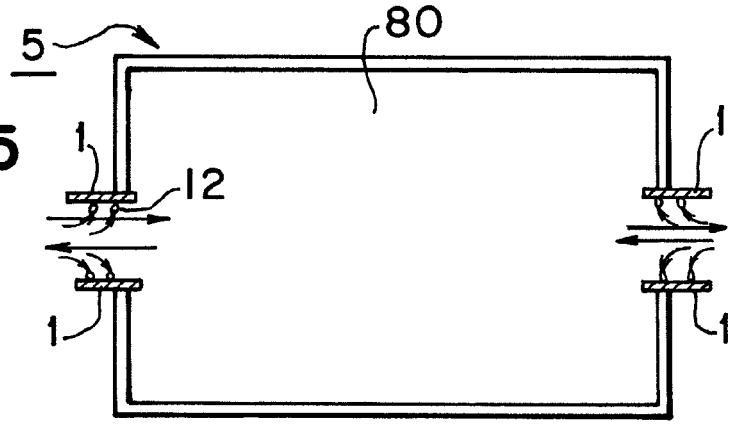
FIG. 15 is a diagrammatic view for showing a 14th embodiment of flotage trapping system.

The 14th embodiment concerns a flotage trapping system (clean room) or the usage of the flotage trapping device preferably comprising the plate described in the 5th embodiment or the sheet or film described in the 6th embodiment. FIG. 15 is a diagrammatic view for showing a 14th embodiment of flotage trapping system. In FIG. 15, a clean room 80 which has an entrance and exit without door is provided with flotage trapping devices 1 at the entrance and exit on the opposite sides thereof. The dust which is coming in the clean room from the outside is captured by the electrodes. Therefore, the floating dust cannot pass through the entrance and exit, although the members and some wind can pass.

15th Embodiment

The 15th embodiment concerns the clean room, not shown, around and/or inside which the flotage trapping device is disposed instead of the flotage trapping device disposed in the work site. The dust floating in the clean room is captured by the flotage trapping device and thus the clean room without dust can be achieved.

Conventionally, for the clean room, the dust is removed by an HEPA filter provided on the ceiling so that the dust does not come in from the outside, and the dust coming from the member or human body is blown down by down-flow and is collected through collection openings provided on a floor or lower wall. On the other hand, since according to the present invention the dust coming in from the outside can be captured and collected with no wind inside the clean room regardless whether the HEPA filter or down-flow is present or not, purification can be positively made, and cost of equipment is very inexpensive.

16th Embodiment

Figure 16:
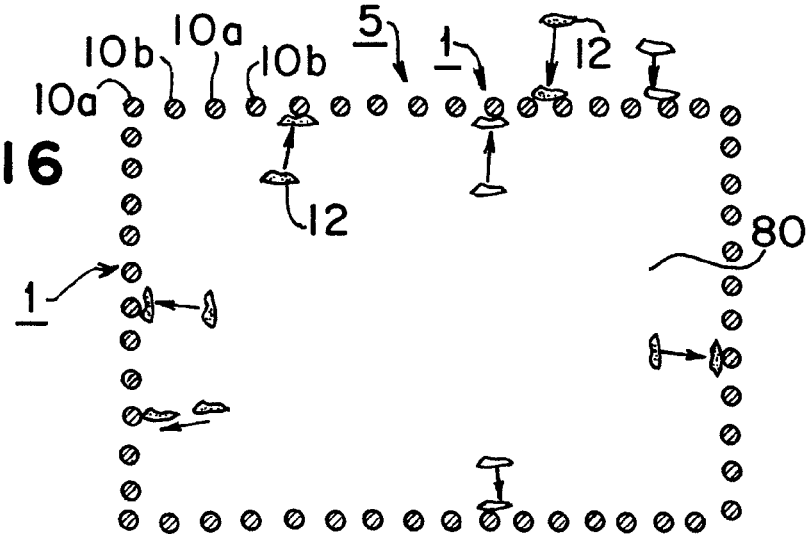
FIG. 16 is a diagrammatic view for showing a flotage trapping system or a clean room without walls using the prototype, dust trapping net or dust trapping lattice of the first to third embodiments.

The 16th embodiment concerns a flotage trapping system (clean room with no wall) preferably comprising the prototype of dust trapping device described in the first embodiment, the dust trapping net described in the second embodiment or the dust trapping hanging warp described in the third embodiment. FIG. 16 is a diagrammatic view for showing a flotage trapping system or a clean room without walls using the prototype, dust trapping net or dust trapping lattice of the first to third embodiments. In the FIG. 16 the flotage trapping device 1 is disposed around a space. The dust which is coming in the space from the outside is captured and the dust floating in the space is also captured to form a clean room 80 inside of which no dust is present. That is, a clean room with no wall therearound can be achieved. With the clean room, the wind freely comes in and out. For example, the space without dust in which temperature and moisture can be controlled in common with the outside can be achieved. Therefore, costs of equipment and operation is very economical compared with conventional clean rooms.

17th Embodiment

The 17th embodiment concerns a flotage trapping system (bi-directional filter) using the flotage trapping device described in the first to 6th embodiments. FIG. 17 is a view for explanation on a 17th embodiment of flotage trapping system, FIG. 17*a* is its cross-sectional view of a 17th embodiment of bi-directional filter, and FIGS. 17*b* and 17*c* are cross-sectional views of conventional physical filters.

Figure 17A:
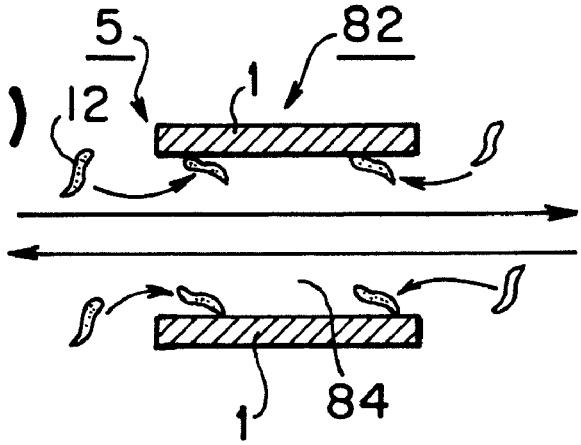
FIG. 17*a* is its cross-sectional view of a 17th embodiment of bi-directional filter.
Figure 17B:
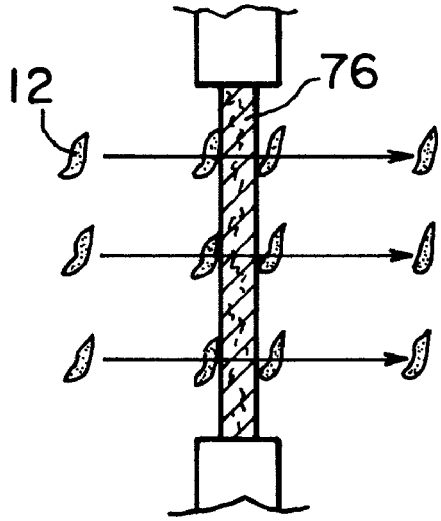
FIGS. 17*b* and 17*c* are cross-sectional views of conventional physical filters.
Figure 17C:
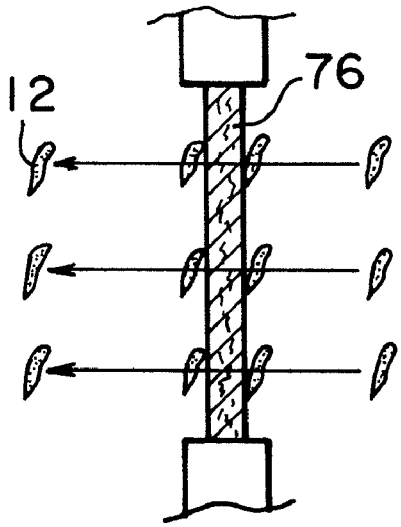

As shown in FIGS. 17*b* and 17*c*, a conventional filter 76 is a one-direction one in which air should be filtered only in a direction. If a wind is blown in an opposite direction, the dust 12 which has been collected once will fly off again. Furthermore only a wind can pass through the filter and a body cannot pass through the filter.

On the other hand, as shown in FIG. 17*a*, a bi-directional filter 82, flotage trapping system, according to the present invention is provided with an air hole 84 around which the flotage trapping device 1 is disposed circularly. When a wind pass through the air hole, the dust included in the wind is captured and only a clean air can pass. Since the wind can pass bi-directionally, a bi-direction filter can be achieved. Thus, this filter has a bi-direction filtering function, and the body can pass freely since the filter is not a physical filter.

18th Embodiment

Figure 18:
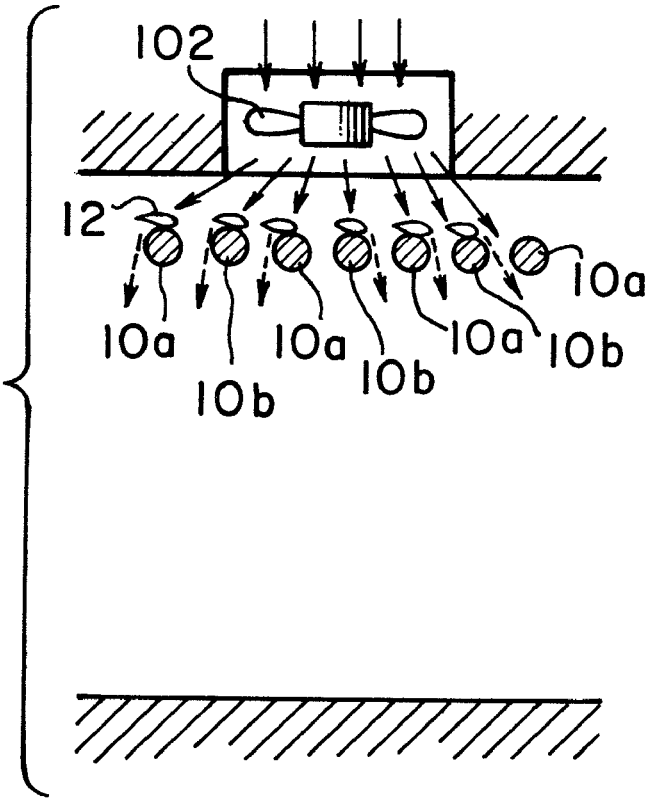
FIG. 18 is a view for explanation on a flotage trapping device applied to an air conditioner for showing a 18th embodiment.

The 18th embodiment concerns the flotage trapping device applied to a blowout opening of air conditioner. FIG. 18 is a view for explanation on a flotage trapping device applied to an air conditioner. In FIG. 18, the flotage trapping device comprising electrodes 10 is juxtaposed at a blowout opening of air conditioner 102 attached to the ceiling. Usually the circumference of the blowout opening of air conditioner is contaminated in black. This is the dust adhered to the circumference of the blowout opening. As a whole a great deal of dust is scattered in a space. Such dust is collected.

19th Embodiment

Figure 19:
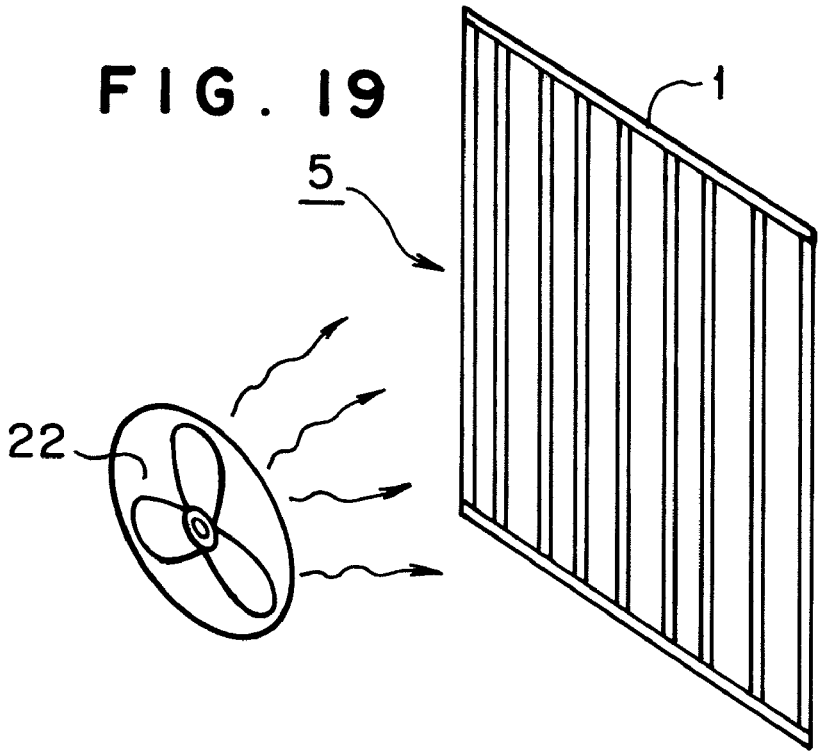
FIG. 19 is a diagrammatic perspective view for showing a 19th embodiment of flotage trapping system.

The 19th embodiment concerns a flotage trapping system preferably able to combine with the first to third embodiments. FIG. 19 is a diagrammatic perspective view for showing a 19th embodiment of flotage trapping system. As shown in FIG. 19, a breeze generating device 22 such as a fan or the like is disposed in front of or behind the flotage trapping device 1 to blow wind toward the flotage trapping device 1 so that the flotage floating in the space can be captured more strongly. However, there is a problem of blowing off the dust. Therefore this flotage trapping system is suitable for blowing off and collecting the accumulated dust.

20th Embodiment

Figure 20:
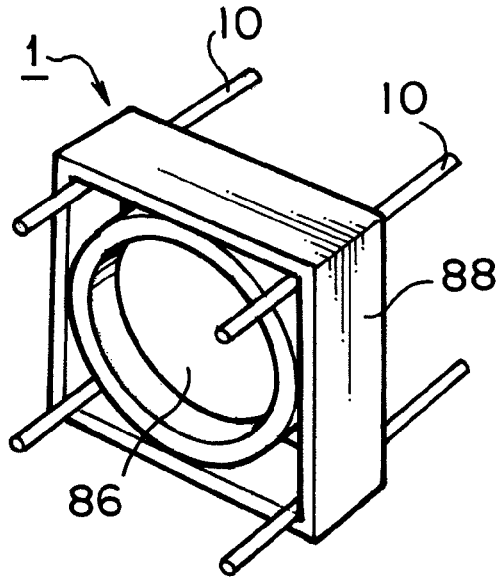
FIG. 20 is a perspective view for showing a 20th embodiment of maintenance-free optical lens device.

The 20th embodiment concerns a maintenance-free optical lens in which the flotage trapping device is incorporated. FIG. 20 is a perspective view for showing a 20th embodiment of maintenance-free optical lens device. An optical lens is covered with an electrode holder for holding electrodes at its circumference to capture the dust coming in from the outside. The dust is not attached to the optical lens and thus the maintenance thereof is not required for a long time.

21st Embodiment

Figure 21:
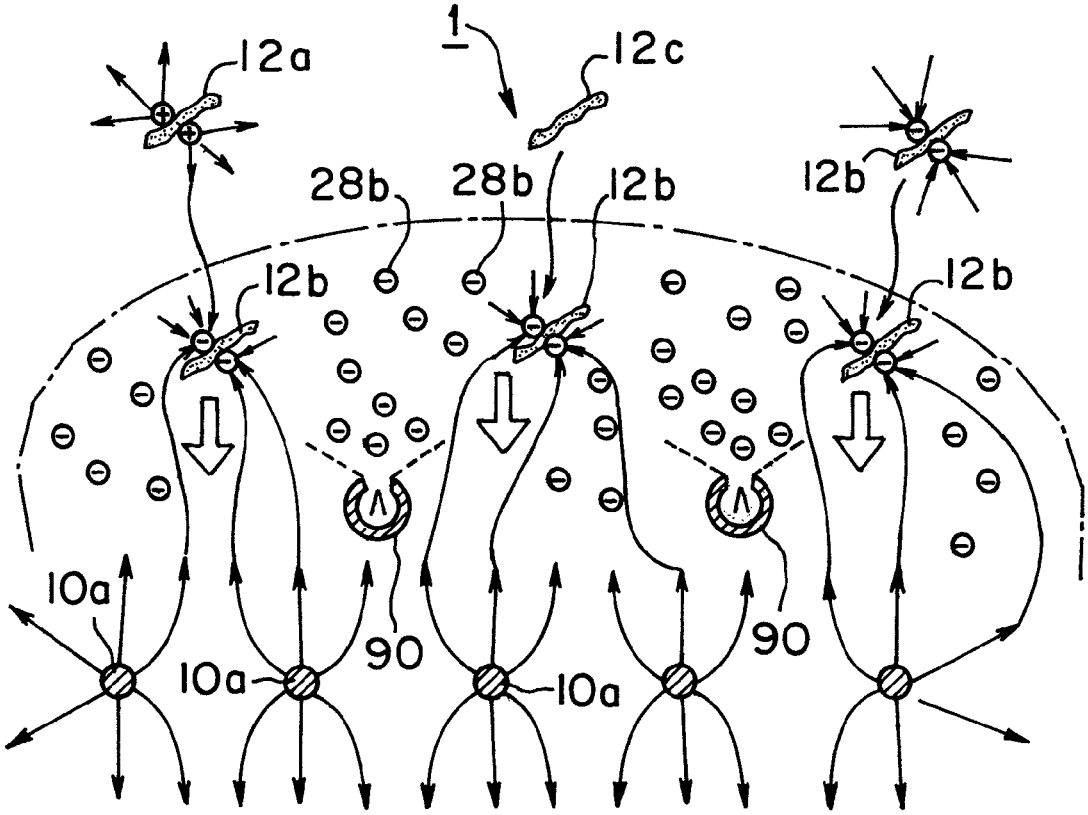
FIG. 21 is a view for explanation on a 21st embodiment of prototype of flotage trapping device using an ion generating device comprising a single polarity of electrodes (plus electrodes or minus electrodes) and an opposite polarity of electrodes.

The 21st embodiment concerns a flotage trapping device using a single polarity of electrodes, plus electrodes or minus electrodes and a space ion generating device for generating ions of polarity opposite to that of the electrodes. FIG. 21 is a view for explanation on a 21st embodiment of prototype of flotage trapping device using an ion generating device comprising a single polarity of electrodes (plus electrodes or minus electrodes) and an ion generating device for generating ions of polarity opposite to that of electrodes.

The flotage trapping device comprises a single polarity of at least one electrode, plus or positive electrodes 10*a* in this embodiment, and a space ion generating device for generating ions 28*b* of polarity opposite to that of electrodes, minus or negative ions in this embodiment. The ion generating device issues ions so that ions float adjacent or around the electrodes. The flotage trapping device can captures the flotage floating in the air without using an air blow generating device such as a fan.

As shown in FIG. 21, for example the electrodes are provided with plus voltage to induce plus electrodes 10*a* and the electrodes is covered with ions 28*b* generated from the space ion generating device 90. The dust, plus charged dust 12*a* or no charged dust 12*c*, except for the minus charged dust 12*b* is charged with minus electricity by the minus ions 28*b* in itself. Since the plus electrodes issue electric flux lines the dust thus charged with minus electricity is captured. Although there are many cases that the floating dust is charged with plus electricity or minus electricity, or the quantity of charge is low or zero, By being covered with a polarity of ions, all dust is forcibly charged with that polarity, and attracted and captured by the electrodes of opposite polarity. Even the dust with few quantity of charge can be captured surely.

22nd Embodiment

Figure 22:
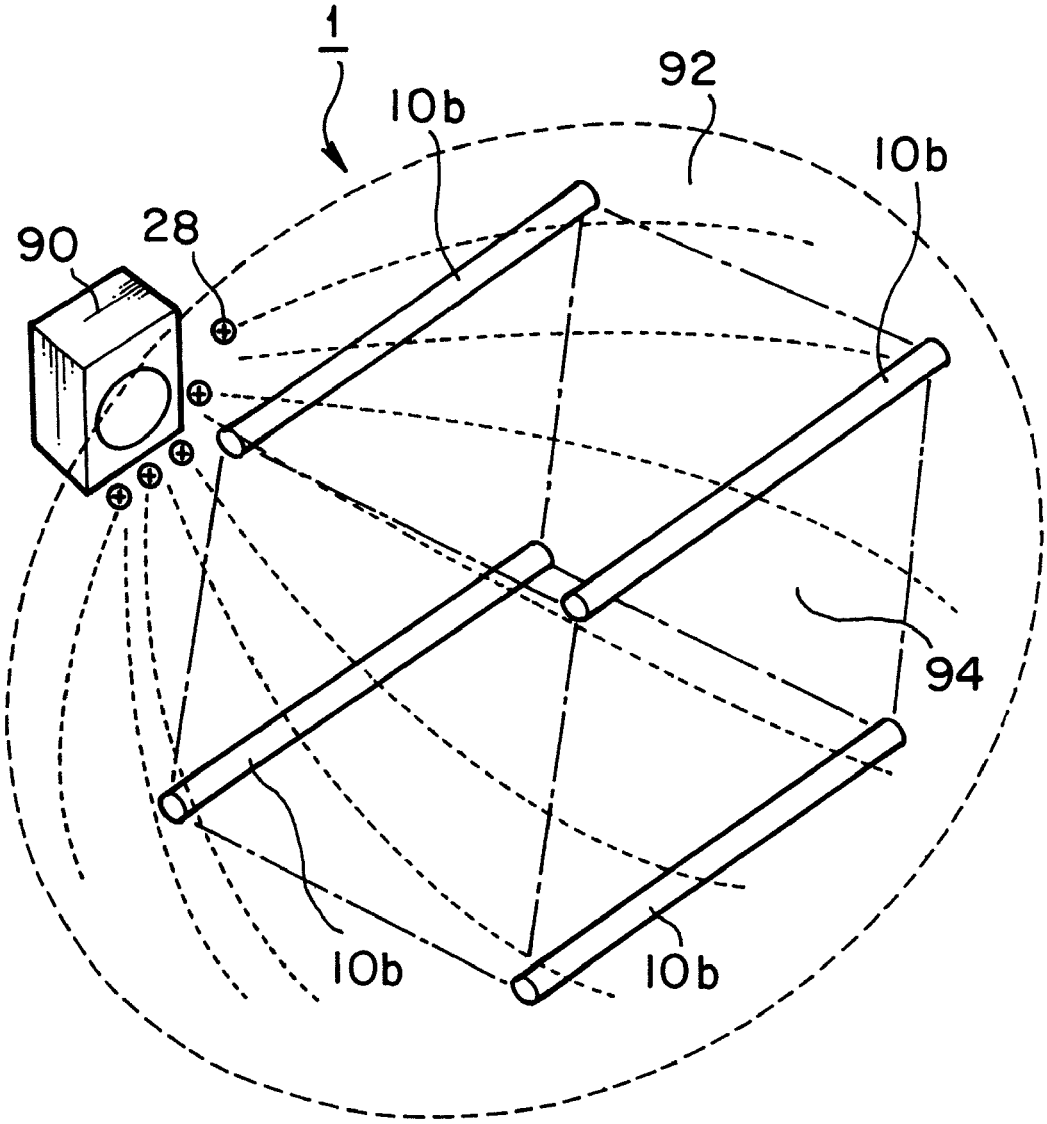
FIG. 22 is a view for explanation on a 22nd embodiment of space dust control device using an ion generating device comprising a single polarity of electrodes (plus electrodes or minus electrodes) and an ion generating device for generating ions of the opposite polarity as that of electrodes.

The 22nd embodiment concerns another space dust control device using a single polarity of electrodes, plus electrodes or minus electrodes and a space ion generating device for generating ions of polarity opposite to that of the electrodes. FIG. 22 is a view for explanation on a 22nd embodiment of space dust control device using an ion generating device comprising a single of electrodes polarity (plus electrodes or minus electrodes) and an ion generating device for generating ions of polarity opposite to that of electrodes.

As shown in FIG. 22, a space dust control device 1 or flotage trapping device comprises a single polarity of electrodes, minus electrodes 10*b* in this embodiment, for encompassing a space so as to provide a dust control space 94, and a space ion generating device 90 for generating ion of polarity opposite to that of electrodes, plus ions 28*a* in this embodiment, to form an ion space 92 surrounding the dust control space.

As shown in FIG. 22, the ions generated by the space ion generating device 90 cover the dust control space 94 encompassed by the electrodes 10*b* provided with minus voltage and its circumference. Since the dust in the ion space and the dust coming in from the outside are charged with plus electricity, the dust is attracted and captured by the electrodes charged with minus electricity. As a result the dust control space inside of which the dust is not present is formed.

23rd Embodiment

Figure 23A:
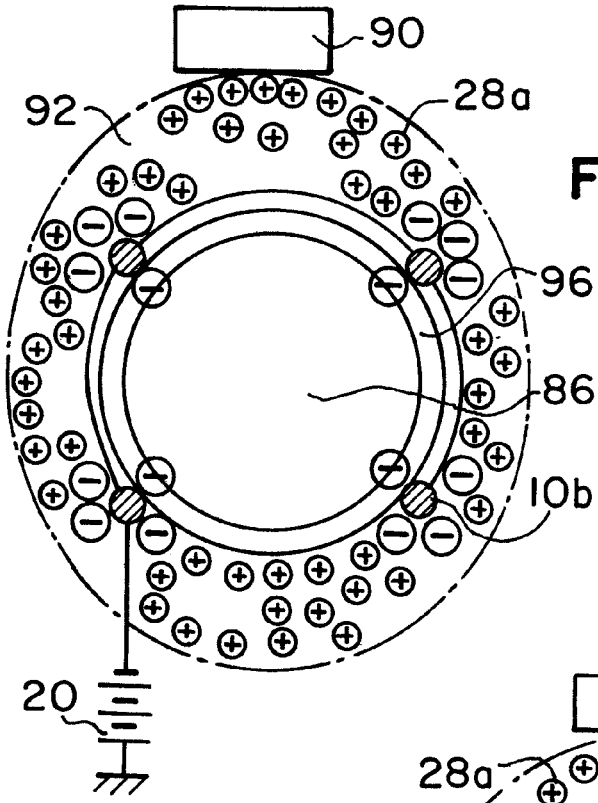
FIG. 23*a* is its front view and FIG. 23*b* is its side view.
Figure 23B:
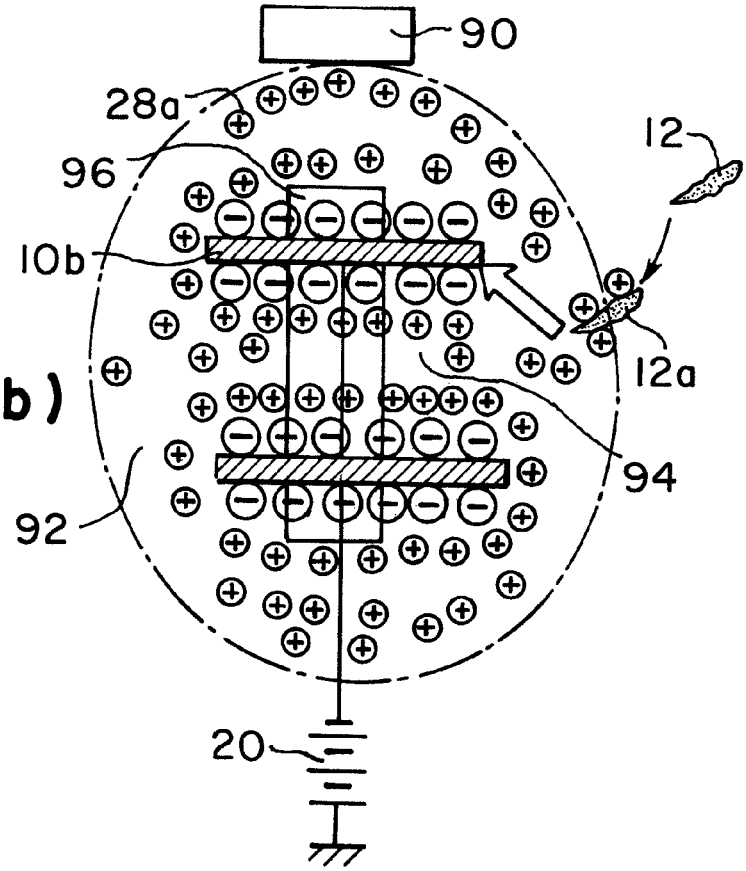

The 23rd embodiment concerns another maintenance-free optical lens or flotage trapping device, using a single polarity of electrodes (plus electrodes or minus electrodes), and a space ion generating device for generating ions of polarity of opposite to that of the electrodes. FIG. 23 is a view for explanation on another maintenance-free optical lens device using a space ion generating device comprising a single polarity of electrodes (plus electrodes or minus electrodes) and an ion generating device for generating ions of polarity opposite to that of electrodes, FIG. 23*a* is its front view and FIG. 23*b* is its side view.

As shown in FIG. 23, an optical lens 86 which is accommodated in a lens-barrel 96 is disposed inside a dust control space 94 in an ion space 92. As a result the dust is not attached to the lens for the same reason as explained in the 21st embodiment.

In the embodiment, the minus electrodes 10*b* fed by a power supply 20 and plus ions 28*a* generated by the space ion generating device 90 are used. The dust coming in from the outside gets into touch with floating plus ions 28*a* to be charged with plus electricity, and attracted and captured by the minus electrodes 10*b*. Since the dust cannot reach the optical lens inside the dust control space, the dust is not attached to the optical lens.

24th Embodiment

Figure 24:
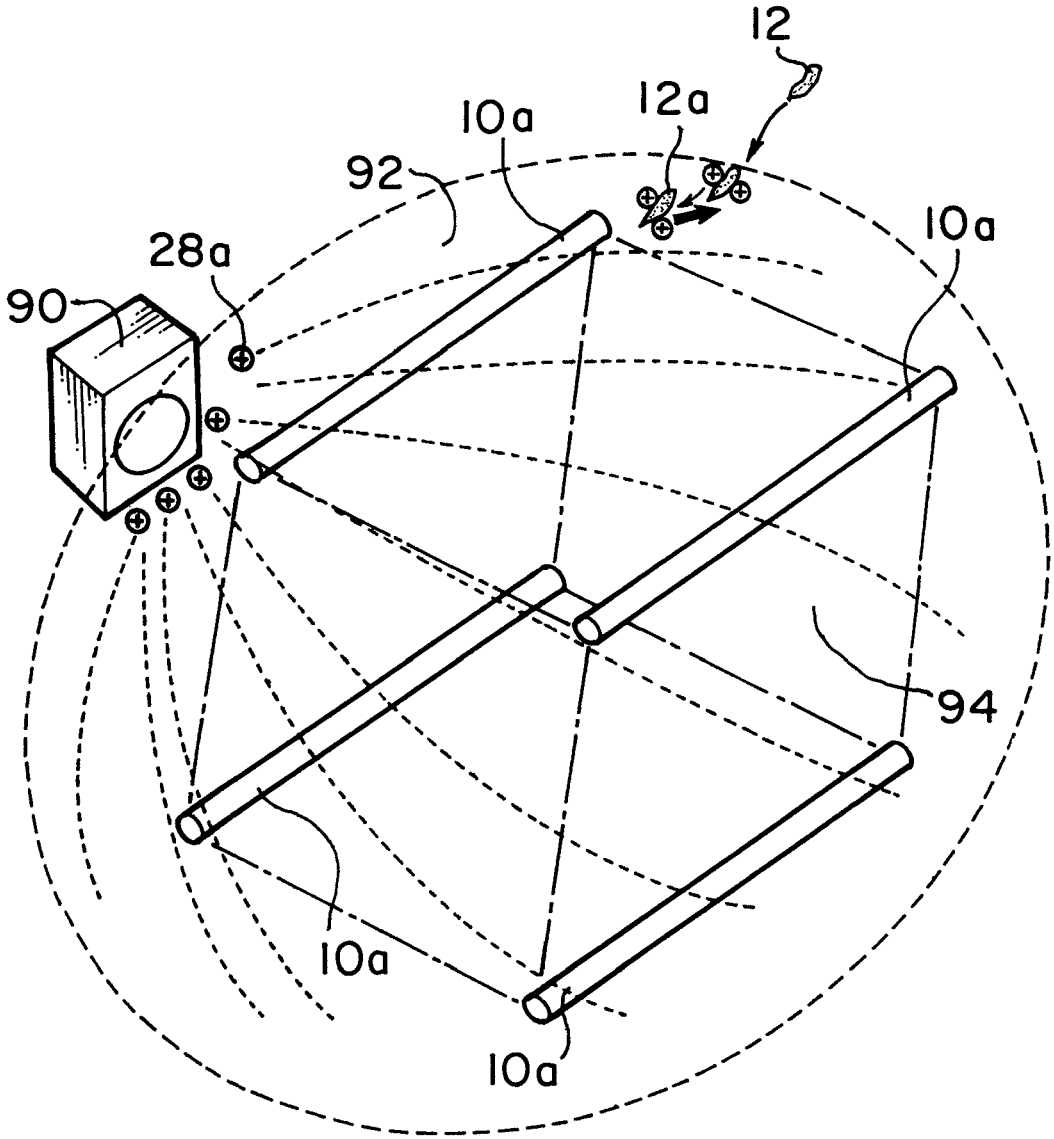
FIG. 24 is a view for explanation on a 24th embodiment of space dust control device using a space ion generating device comprising a single polarity of electrodes (plus electrodes or minus electrodes) and an ion generating device for generating ions of the same polarity as that of the electrodes.

The 24th embodiment concerns a still another dust control device or a flotage repelling device, using a single polarity of electrodes (plus electrodes or minus electrodes), and a space ion generating device for generating ions of the same polarity as that of the electrodes. FIG. 24 is a view for explanation on a 24th embodiment of space dust control device using a space ion generating device comprising a single polarity of electrodes (plus electrodes or minus electrodes) and an ion generating device for generating ions of the same polarity as that of the electrodes.

As shown in FIG. 24, the dust control device comprises a dust control space 94 surrounded by electrodes provided with plus voltage and an ion generating device 90 for generating and floating plus ions 28*a* of the same polarity as that of the electrodes around the dust control space 94. The dust 12 coming in from the outside gets into touch with floating plus ions 28*a* and turns out to be a plus dust 12*a* charged with plus electricity. When the plus dust 12*a* approaches to the plus electrodes 10*a*, since the plus electrodes 10*a* repels the plus dust 12*a*, the plus dust is flied away and thus the dust cannot enter the dust control space. Consequently the dust control space without dust can be formed.

25th Embodiment

Figure 25A:
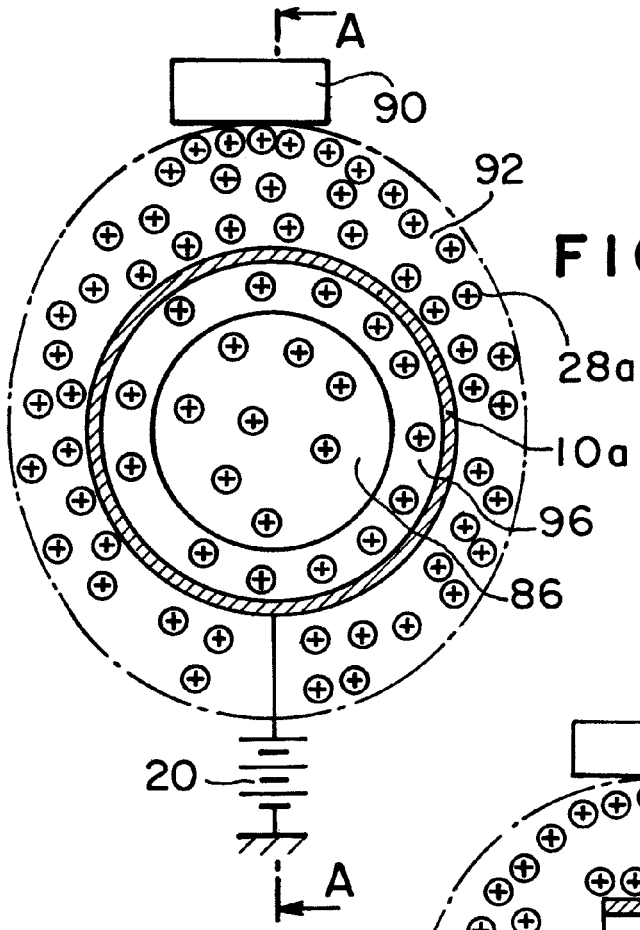
FIG. 25*a* is its front view and FIG. 25*b* is its side view.
Figure 25B:
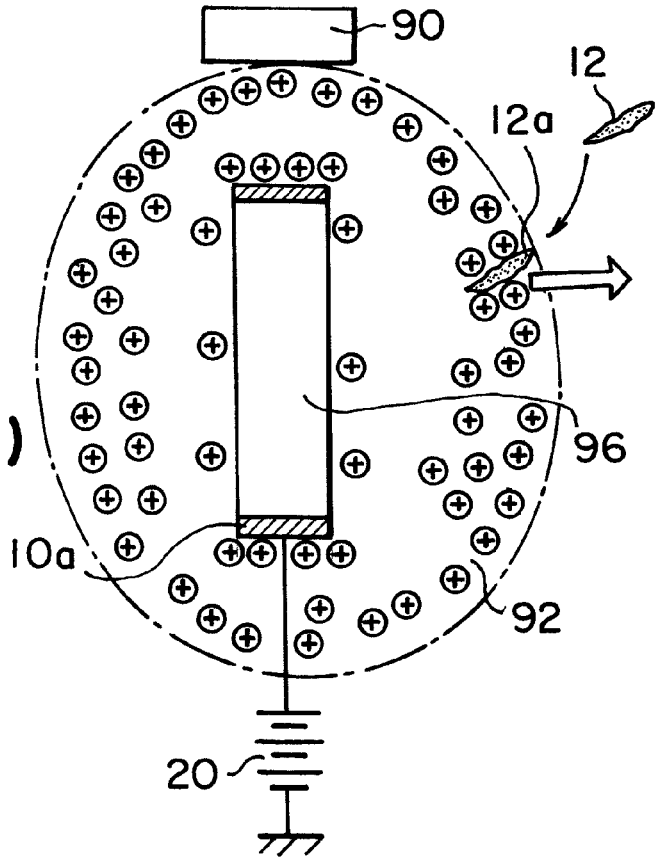

The 25th embodiment concerns a still another maintenance-free optical lens device or a flotage repelling device, using a single polarity of electrodes, plus electrodes or minus electrodes, and a space ion generating device for generating ions of the same polarity as that of electrodes. FIG. 25 is a view for explanation on a still anther maintenance-free optical lens device using a space ion generating device comprising a single polarity of electrodes (plus electrodes or minus electrodes) and an ion generating device for generating ions of the same polarity as that of electrodes, FIG. 25*a* is its front view and FIG. 25*b* is its side view.

As shown in FIG. 25, the optical lens device comprises a dust control space surrounded by an electrode 10*a* provided with plus voltage, an ion generating device 90 for generating and floating ions 28*a* of the same polarity as that of the electrode around the dust control space, a lens 86 disposed within the dust control space, and lens-barrel 96. The dust which comes in from the outside gets into touch with plus ions and turns out to be a dust 12*a* charged with the same polarity as that of plus ions. In the meanwhile electric leak occurs from the electrode surrounding the lens 86 toward the lens 86. Therefore, the lens 86 is likely to be charged with the same polarity as that of the electrode 10*a*. Since the plus dust is of the same polarity as that of the electrode 10*a*, and thus is repelled by the electrode 10*a*. As a result the dust cannot be attached to the optical lens 86 inside the electrode. In the embodiment, the electrode 10 is wound around the lens 86.

26th Embodiment

Figure 26A:
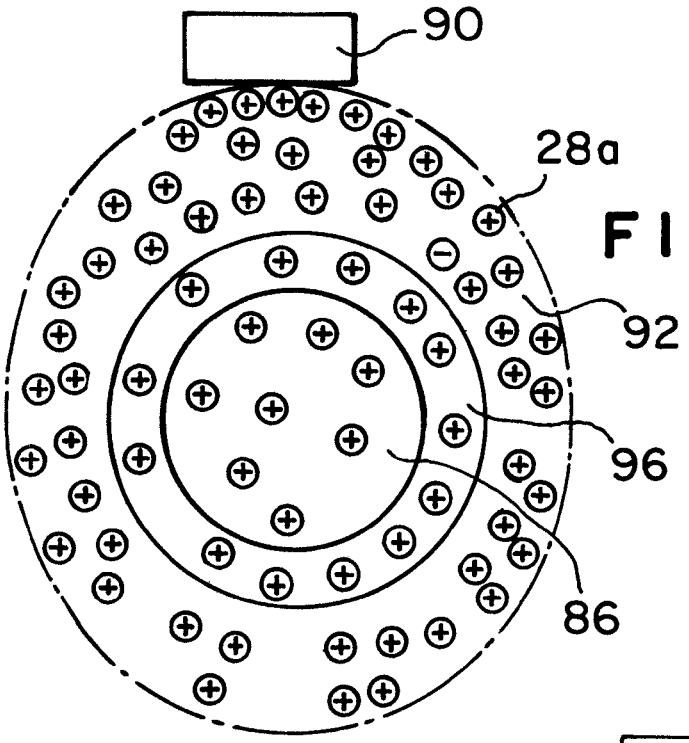
FIG. 26*a* is its front view and FIG. 26*b* is its side view.
Figure 26B:
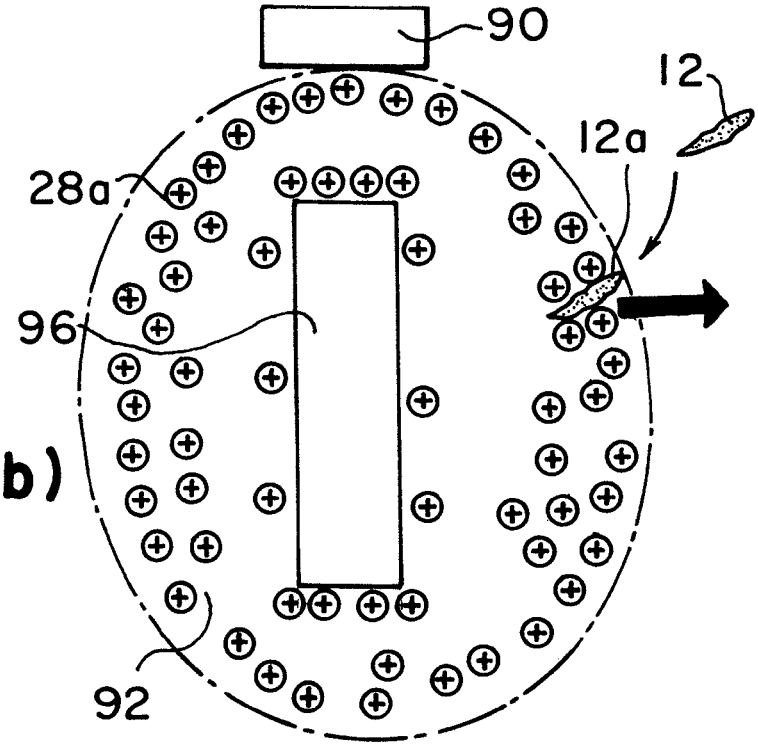

The 26th embodiment concerns a still another maintenance-free optical lens or a flotage repelling device, using a space ion generating device. FIG. 26 is a view for explanation on a still anther maintenance-free optical lens device using a space ion generating, FIG. 26*a* is its front view and FIG. 26*b* is its side view.

The lens 86, which is an object of dust control, is disposed through an insulator, not shown, with being not grounded within an ion space 92 of a single polarity issued from the space ion generating device. The lens is charged with the same polarity as that of surrounding ions 28*a* while the floating dust or the dust coming in from the outside is also charged the same polarity as that of ions. Since both are charged with the same polarity, they are repelled to each other, and thus the dust is not attached to the lens.

27th Embodiment

Figure 27A:
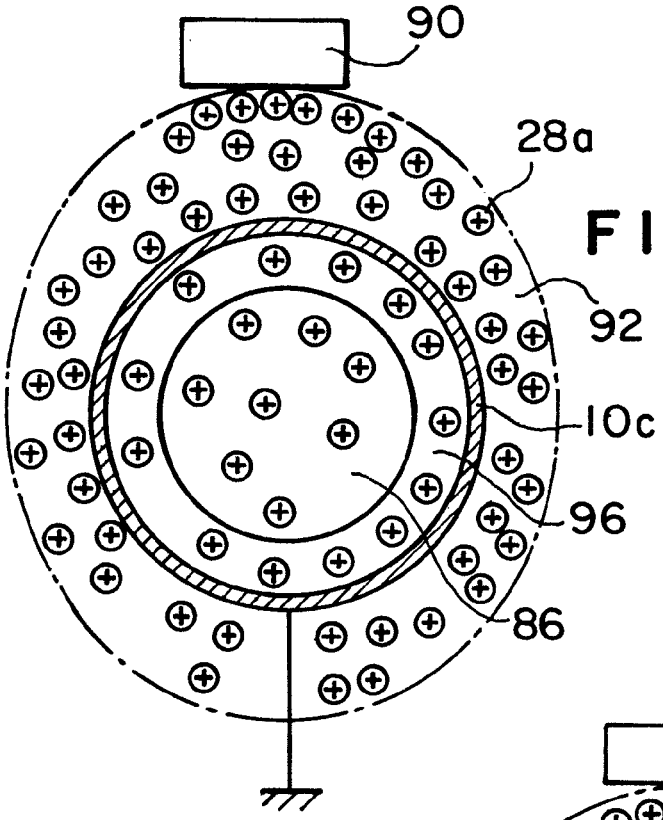
FIG. 27*a* is its front view and FIG. 27*b* is its side view.
Figure 27B:
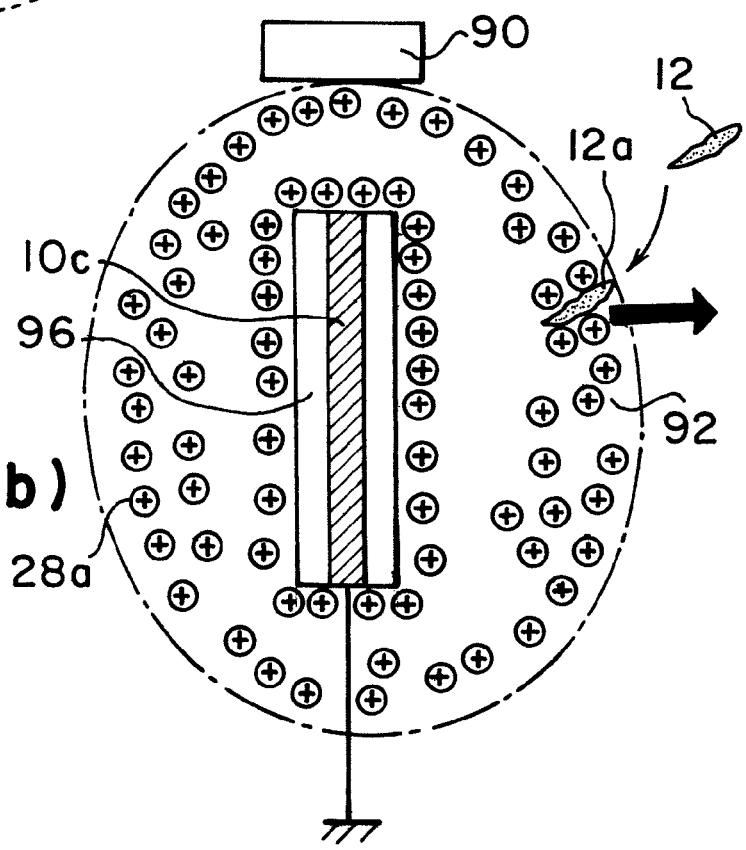

The 27th embodiment concerns a still another maintenance-free optical lens or a flotage repelling device, using an electrode with no charge or grounded electrode and a space ion generating device. FIG. 27 is a view for explanation on a maintenance-free optical lens using a grounded electrode and a space ion generating device, FIG. 27 is its front view and FIG. 27*b* is its side view.

Inside the ion space 92 formed by the space ion generating device 90 for generating ions of single polarity, plus ions 28*a* in this embodiment, an electrode 10*c* which is grounded to the earth and provided around a lens, an object of dust control, is disposed. Since the plus ions 28*a* are attracted by the grounded electrode and gather together around the grounded electrode, the density of plus ions 28*a* can be increased and thus the approaching dust is charged surely and can be repelled.

28th Embodiment

Figure 28:
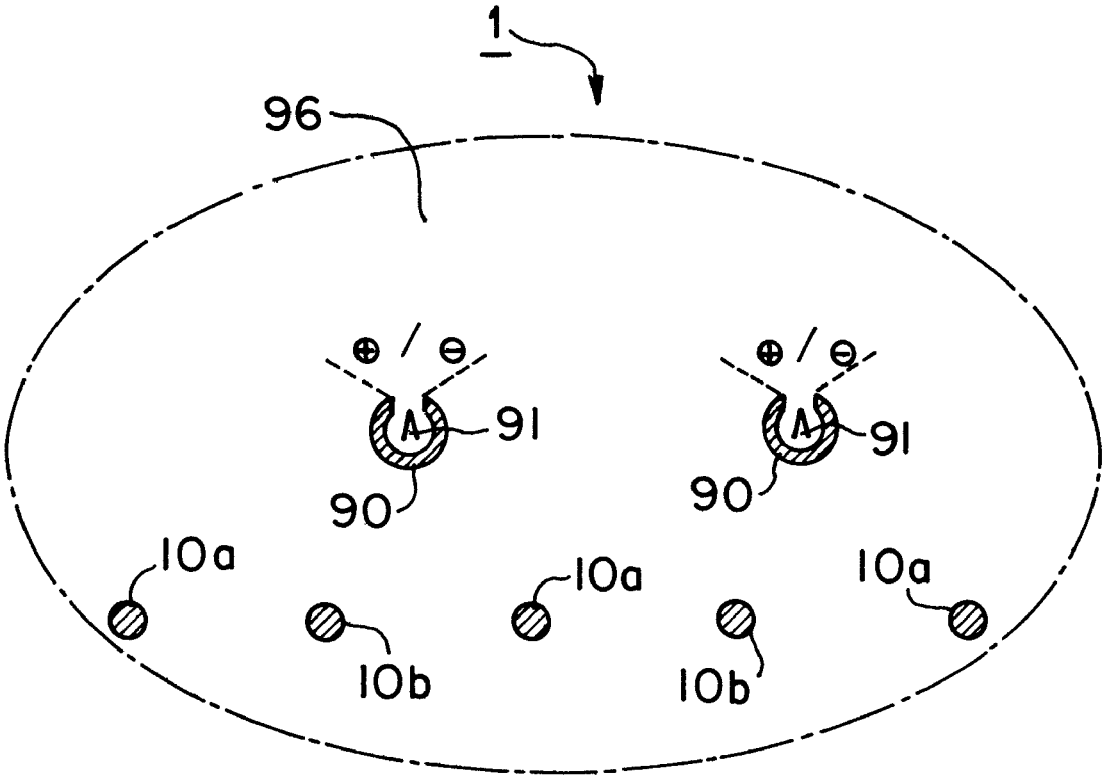
FIG. 28 is a view for explanation on a flotage trapping device using a space ion generating device in which polarities of discharge electrodes are alternately switched over.

The 28th embodiment concerns a flotage trapping device using a space ion generating device in which polarities of discharge electrodes are alternately switched over. FIG. 28 is a view for explanation on a flotage trapping device using a space ion generating device in which polarities of discharge electrodes are alternately switched over. In FIG. 28, the space ion generating device for generating an ion space 92 is provided with discharge electrodes 91 the polarities of which are alternately switched over slowly between plus and minus. In order to circulate ions around the space the switching cycle between a few seconds and several tens of seconds is proper. When plus ions are issued, the dust is charged with plus electricity and attracted by the minus electrodes 10*b*. When minus ions are issued, the dust is charged with minus electricity and attracted by the plus electrodes 10*a*. Since the polarities of ions are switched over between plus and minus, the body located around the ion space is not charged.

29th Embodiment

The 29th and next 30th embodiments concern flotage trapping devices in which the electrodes are provided with various coatings to enhance trapping effects by electrodes and to add other functions to electrodes. FIG. 29 is a cross-sectional view for explanation on a flotage trapping device provided at its electrodes with a variety of coatings to enhance effects of trapping by electrodes and add other functions thereto, and shows as coatings (a) an insulator, (b) an adhesive, (c) a combination of first layer of insulator and second layer of adhesive, (d) a combination of first layer of insulator, second layer of adhesive and third layer of sterilizer, (e) a combination of first layer of insulator and second layer of adhesive including sterilizer, (f) a high resistive element, (g) a conductive adhesive, and (h) a photocatalyst.

Figure 29A:
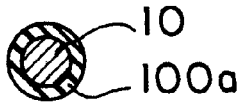
FIG. 29 is a cross-sectional view for explanation on a flotage trapping device provided at its electrodes with a variety of coatings to enhance effects of trapping by electrodes and add other functions thereto, and shows as coatings (a) an insulator, (b) an adhesive, (c) a combination of first layer of insulator and second layer of adhesive, (d) a combination of first layer of insulator, second layer of adhesive and third layer of sterilizer, (e) a combination of first layer of insulator and second layer of adhesive including sterilizer, (f) a high resistive element, (g) a conductive adhesive, and (h) a photocatalyst.

As shown in FIG. 29*a*, the electrode 10 is covered with a coating of insulator 100*a*. This prevents electric shock accidents.

Figure 29B:
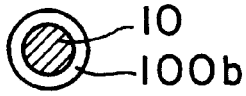

As shown in FIG. 29*b*, the electrode 10 is covered with an adhesive 100*b* as a coating. Since the dust is adsorbed by the adhesive 100*b* in addition to the electric adsorption by the electrode 10, the dust once trapped is not separated from the electrode and thus its trapping effects can be enhanced.

Figure 29C:
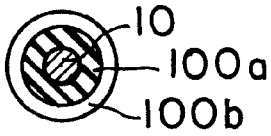

As shown in FIG. 29*c*, the electrode 10 is covered with an insulator 100*a* as a first layer which in turn is covered with an adhesive 100*b* as a second layer. Consequently, the trapping effects can be enhanced.

Figure 29D:
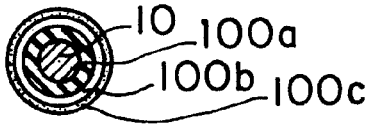

As shown in FIG. 29*d*, the electrode 10 is covered with an insulator 100*a* as a first layer which in turn is covered with an adhesive 100*b* as a second layer. Furthermore, the adhesive 100*b* is covered with a sterilizer 100*c* as a third layer. Introduction of hospital is one of usages for the embodiment. If the device is used in the hospital in which virus is frequently attached to the dust, the virus floating in the air can be trapped and sterilized. Especially, it is useful for measure for highly contagious SARS.

Figure 29E:
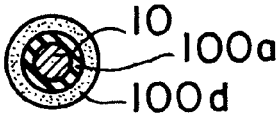

As shown in FIG. 29*e*, the electrode 10 is covered with an insulator 100*a* as a first layer which in turn is covered with an adhesive 100*d* including a sterilizer as a second layer. Consequently, the virus floating in the air can be trapped and sterilized.

Figure 29F:
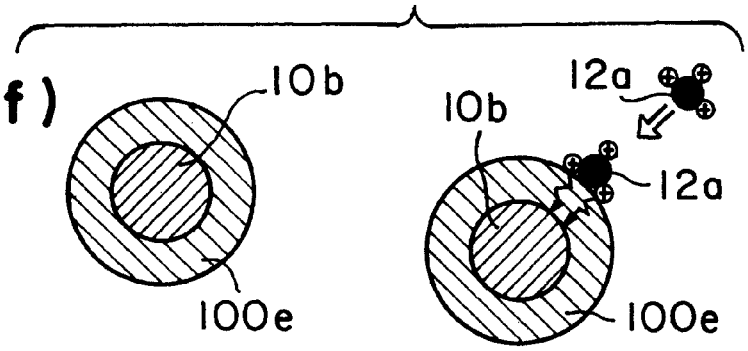

As shown in the enlarged cross-sectional view of FIG. 29*f*, the electrode 10 of, for example, minus polarity is covered with a conductive but highly resistive element 100*e*. This prevents electric shock accidents. Furthermore, for example, when the plus dust 12 such as coating mist is attached to the covered high resistive element 100*e*, as shown by zigzag arrows, the charge is discharged to the minus electrode 10*b* through the highly resistive element, that is, conductive element, and then disappears. Next coming coating mist is likely to be attached without being repelled. Even if the coating mist is accumulated, its attachment force is not decayed due to the discharge.

Figure 29G:
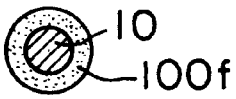

As shown in FIG. 29*g*, the electrode 10 is provided with a highly resistive but conductive adhesive 100*f* as a coating. This prevents electric shock accidents and the attachment force is not decayed for the same reasons as mentioned above. Furthermore, attachment effects can be enhanced.

Figure 29H:
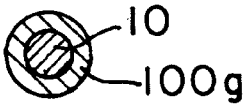

As shown in FIG. 29*h*, the electrode 10 is covered with a photocatalyst as a coating. Since the photocatalyst has a function of decomposing an organic matter when the photocatalyst is illuminated by the light, the captured dust is decomposed, and if the dust is an organic matter, it becomes a gas and thus disappears. As a result the frequency of cleanings can be lowered.

30th Embodiment

Figure 30A:
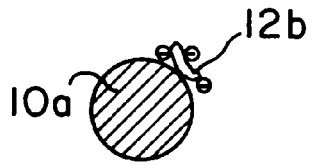
FIG. 30*a* shows the state that the dust is trapped by electrodes and FIG. 30*b* is the state that the dust is removed from the electrodes and is withdrawn.
Figure 30B:
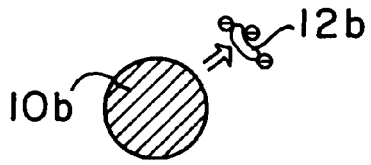
Figure 31:
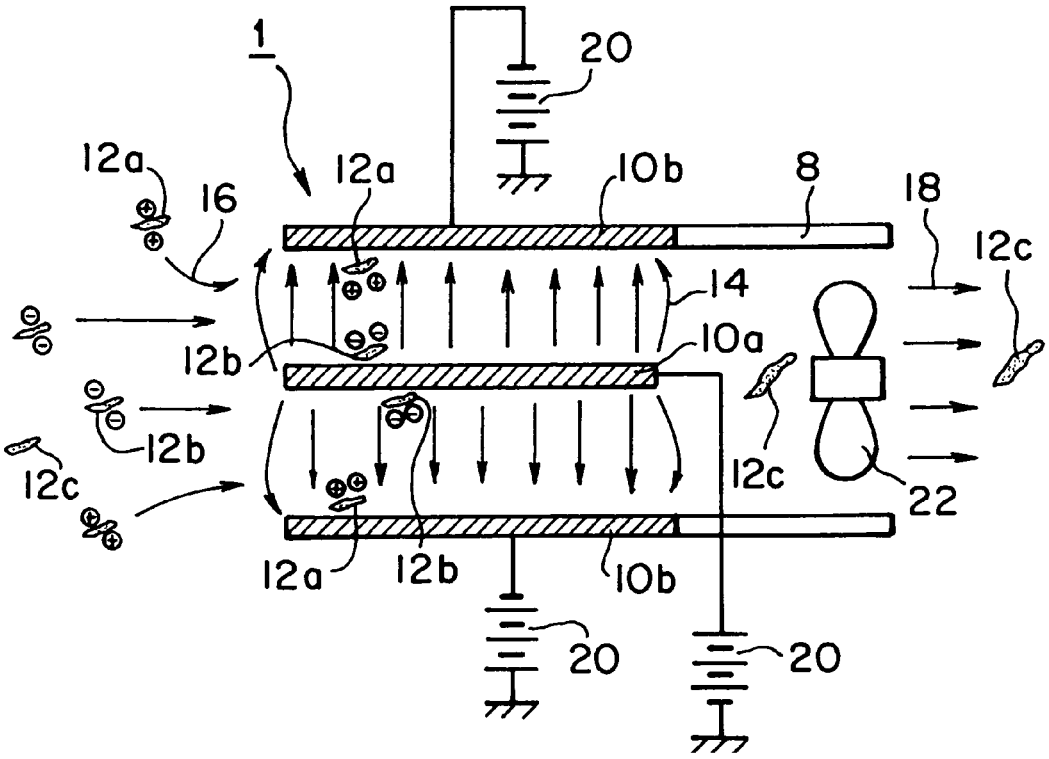
FIG. 31 (PRIOR ART)
FIG. 31 is a diagrammatic view for showing a conventional system in which a wind is blown toward the dust by a fan and the dust is collected by electric field.
Figure 32:
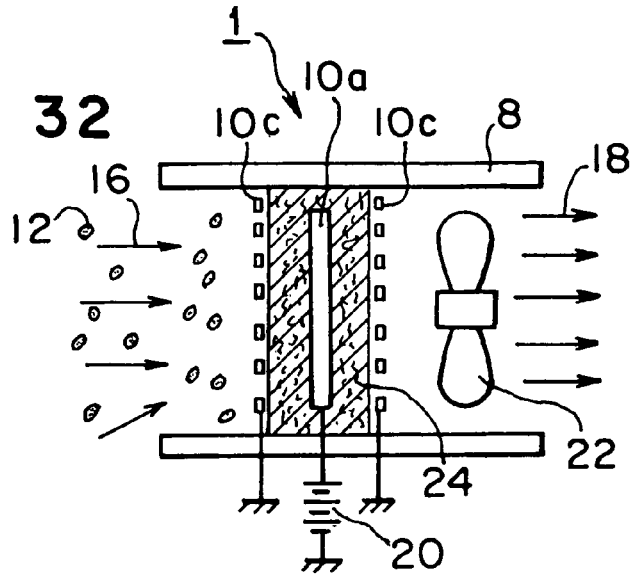
FIG. 32 (PRIOR ART)
FIG. 32 is a diagrammatic view for showing a conventional system in which a wind is blown toward the dust by a fan and the dust is removed by filter provided with electric field.
Figure 33:
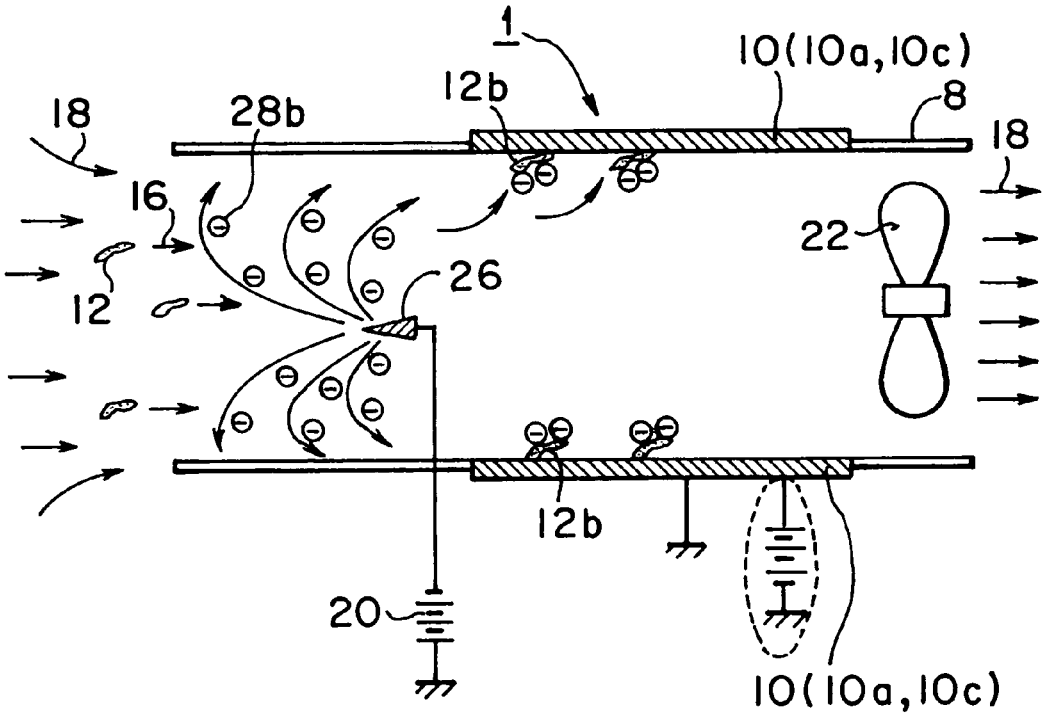
FIG. 33 (PRIOR ART)
FIG. 33 is a diagrammatic view for showing a conventional system in which a wind is blown toward the dust by a fan, the dust is charged with electricity by ions and trapped by electrodes.

The 30th embodiment concerns a flotage trapping device for removing and collecting the trapped dust. FIG. 30 is a view for explanation on the removal and withdrawal of trapped dust at the dust trapping device, FIG. 30*a* shows the state that the dust is trapped by electrodes and FIG. 30*b* is the state that the dust is removed from the electrodes and is withdrawn. As shown in FIG. 30*a*, for example, the electrode 10 is provided with plus voltage and thus the electrode turns out to be a plus electrode 10*a*. At that time, the plus electrode captures minus dust 12*b*. Then, when it is time to remove and collect the dust, as shown in FIG. 30*b* the voltage applied to the electrode is switched over, that is, minus voltage is applied to the electrode, which turns out to be minus one 10*b*. As a result the electrode repels the minus dust 12*b*, and then the dust is removed and collected.

31st Embodiment

Figure 34:
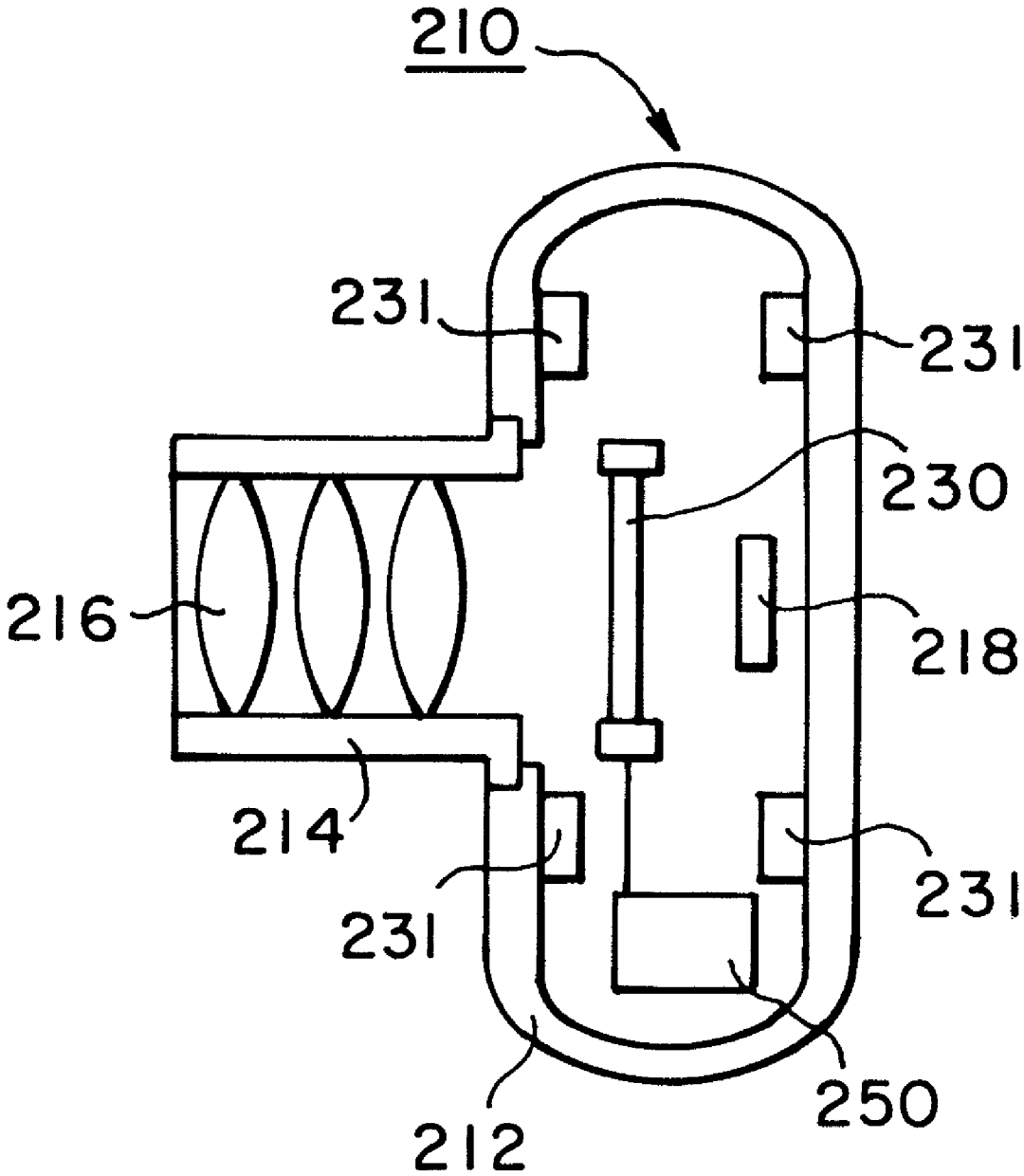
FIG. 34 is a diagrammatic view for showing a digital camera provided with a dust trapping device.
Figure 35A:
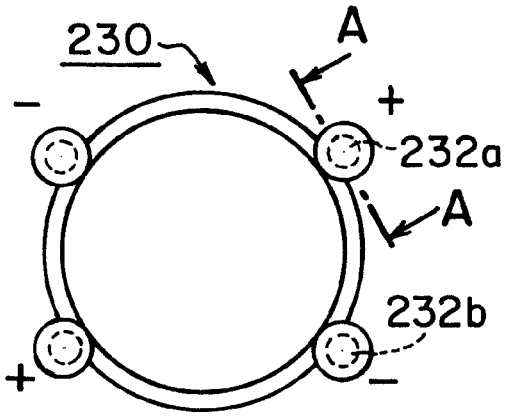
FIG. 35 is a view for showing the dust trapping device in detail, FIG. 35*a* are its front and side views for showing first dust trapping device, FIG. 35*b* are a cross-sectional view taken along line A-A of FIG. 35*a* and a cross-sectional view taken along line B-B of FIG. 35*a*.
FIG. 35*c* is a front view for showing second dust trapping device.
FIG. 35*d* is a cross-sectional view taken along line C-C of FIG. 35*c*.
Figure 35A:
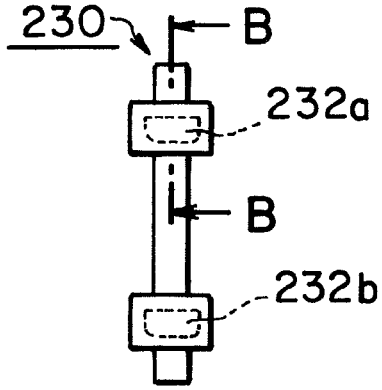
Figure 35B:
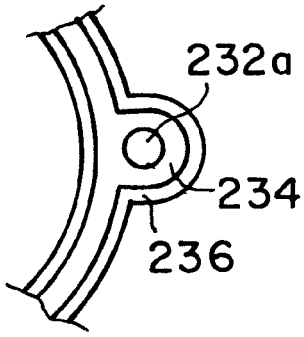
Figure 35B:
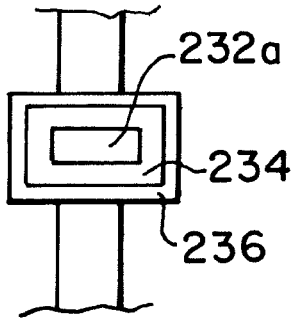
Figure 35C:
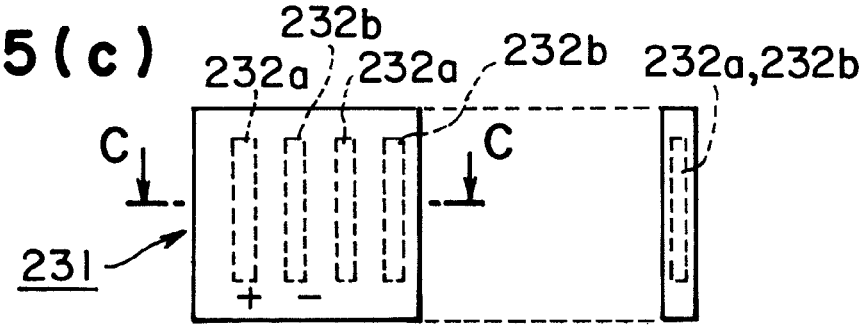
Figure 35D:
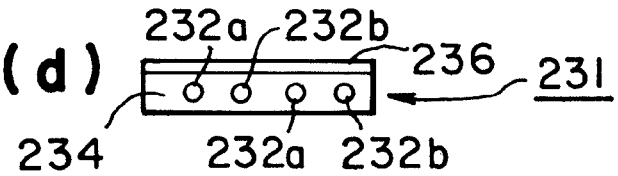
Figure 36:
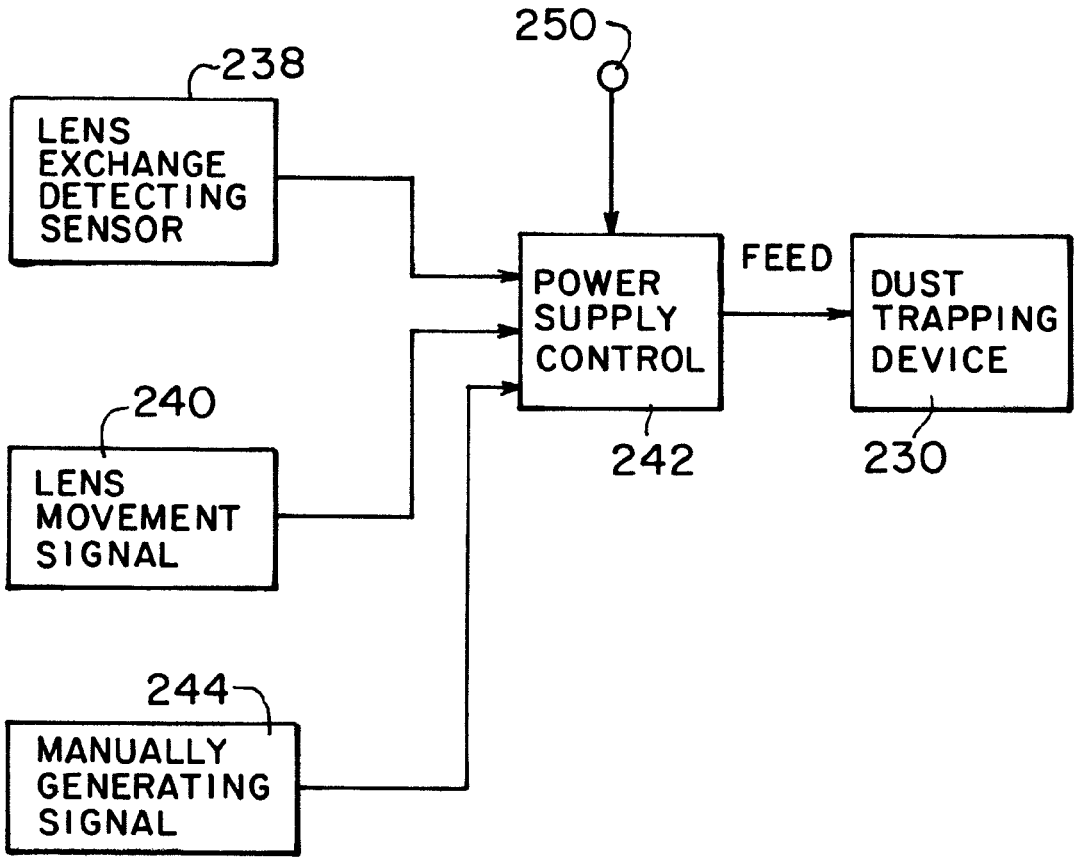
FIG. 36 is a block diagram of control circuit for the dust trapping device.
Figure 37A:
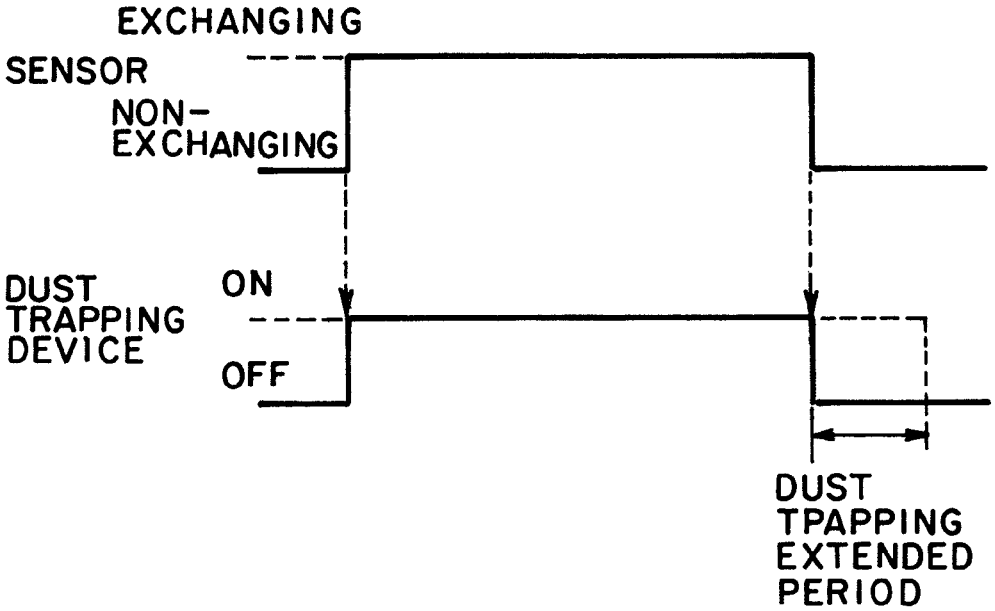
FIG. 37*a* shows the control under exchange of lens and FIG. 37*b* shows the control under movement of lens.
Figure 37B:
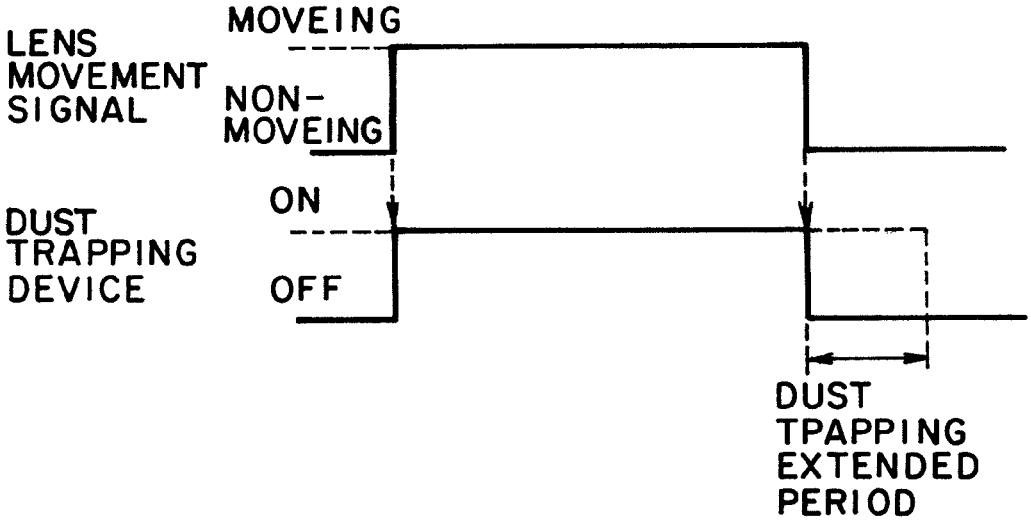

The 31st embodiment concerns a digital camera provided with a dust trapping device. FIG. 34 is a diagrammatic view for showing a digital camera provided with a dust trapping device, FIG. 35 is a view for showing the dust trapping device in detail, FIGS. 35*a* and 35*a*' are its front and side views for showing first dust trapping device, FIGS. 35*b* and 35*b*' are a cross-sectional view taken along line A-A of FIG. 35*a* and a cross-sectional view taken along line B-B of FIG. 35*a*, FIG. 35*c* is a front view for showing second dust trapping device, and FIG. 35*d* is a cross-sectional view taken along line C-C of FIG. 35*c*, FIG. 36 is a block diagram of control circuit for the dust trapping device, and FIG. 37 is a timing chart for power supply controller, FIG. 37*a* shows the control under exchange of lens and FIG. 37*b* shows the control under movement of lens.

In FIG. 34, a digital camera 210 comprises a camera body 212, an exchangeable camera barrel 214 attached to the camera body 212, or a zoom camera barrel 214. The lens 216 is held within the camera barrel 214. An image pickup element 218 such as a CCD or the like is disposed at focusing point of the lens 216.

The present invention is applicable to either a lens exchangeable type or a lens fixed type. In the case of lens exchangeable type, the dust more frequently enters the camera body. This is because the possibility of intrusion of the dust is more frequent when lens exchange is made by user in a dusty environment.

Furthermore, in the case of fixed lens, since the lens is moved back and forth at the time of zoom, focus adjustment or the ON/OFF witching of the power supply, air flows in. Conventionally, at that time the dust is removed by a filter, not shown. However, microscopic dust can pass through the filter. This become a big problem since the miniaturization of the image pickup element 218 progresses in accordance with a current advancement of resolution, and thus very microscopic dust is shown up on the image.

In the present invention, a dust trapping device 230 for capturing dust, hereinafter referred as to a first device is disposed at the circumference in front of the image pickup 218 and/or a plurality of dust trapping device 231, hereinafter referred as to a second device is disposed on the inner walls of the camera body 212. The first device 230 and the second devices 231 are provided with a power supply 250 for supplying high voltage to the first and second devices.

The dust coming in from the outside is attracted and captured by these devices 230 and 231. Since, as mentioned hereinafter, the devices 230 and 231 are provided with adhesive, the dust once captured is not flied away again.

Now, referring to FIG. 35, the first device 230 and the second device 231 are shown in detail. In the devices 230 and 231, plus electrodes 232*a* and minus electrodes 232*b* are alternately disposed and are provided with high voltage from the power supply, see FIG. 34, to generate electric field around them. Although the devices 230 and 231 may be exposed, it is preferable that these devices are covered with an insulator 234 for safety. Furthermore, the insulator 234 is coated with adhesive 236 or provided with adhesive sheet 236. When the adhesion effect of the adhesive is deteriorated the adhesive is coated again. and when the adhesion effect of the adhesive sheet is deteriorated the adhesive sheet is exchanged.

The electric flux lines coming out from the charged dust and the electric flux lines coming out from the electrodes 232*a* and 232*b* interfere with each other to generate electrostatic attraction. As a result the floating dust is attracted by the electrodes 232*a* and 232*b* and attached to the adhesive.

Now, referring to FIG. 36, in the control circuit for the dust trapping device, a signal generated by a sensor 238 for detecting lens exchange, a signal 240 generated by lens movement such as zoom operation, focus adjustment, or switching of ON/OFF or manually generating signal 244 generated manually is supplied to a power supplying control 242 and the devices 230 and 231 are fed by the power supply 250. The sensor may be any proper one such as a microswitch attached to the camera body for detecting the detachment of the camera barrel 214, or the like.

Now, referring to FIG. 37, the power supplying control feeds the devices 230 and 231 at the period for lens exchange or at the period for lens exchange plus a predetermined time lapse period which is provided as an extended period for dust trapping, and at the period for lens movement or at the period for lens movement plus a predetermined time lapse period which is provided as an extended period for dust trapping. Furthermore, if the dust trapping devices are operated while the image is shown up by the image pickup element such as CCD, the quality of image is lowered due to noises issued by the operation of the dust trapping devices. Therefore, it is preferable that the devices 230 and 231 are not operated during that period.

Other Embodiments

Although in explanation of the usages, or applied uses described in the 7th to 19th embodiments, proper preferable embodiments within the 1st to 6th embodiments are taken as examples, the present invention should not be limited to these examples, and includes the embodiments explanations of which is omitted. Furthermore, although in explanation of the object of dust control, a work site, a clean room, a work to be splayed, a die assembly, a storage box, a clean bench, an air shower, a pass box, a bi-directional filter, a lens and the like are taken as examples, the present invention should not be limited to these examples, and can be applied to any proper object required for dust control.

It is understood that many modifications and variations may be devised given the above description of the principles of the invention. It is intended that all such modifications and variations be considered as within the spirit and scope of this invention, as it is defined in the following claims.

The invention claimed is:

1. A flotage trapping device which comprises at least one plus electrode and at least one minus electrode, said plus electrode and minus electrode being alternately disposed, wherein said plus electrode and said minus electrode trap the flotage floating in the air by electrostatic force generated between the flotage and said plus electrode or said minus electode, and wherein said plus electrode and minus electrode are covered with one of the group consisting of: an adhesive material; a combination of a first layer of insulator and a second layer of adhesive; a combination of a first layer of insulator, a second layer of adhesive and a third layer of sterilizer; a combination of a first layer of insulator and a second layer of adhesive including a sterilizer, a highly resistive element, a conductive adhesive, and a photocatalyst, and further wherein said plus electrode and said minus electrode are constructed in the form of a rod, and said plus electrode and said minus electrode are formed with parts spaced by intervals and alternately disposed.

* * * * *